US007021228B2

(12) United States Patent
Robb

(10) Patent No.: US 7,021,228 B2
(45) Date of Patent: Apr. 4, 2006

(54) ROAD TOWED FERRY

(76) Inventor: Gary K. Robb, 909 Marina Village Pkwy., N#395, Alameda, CA (US) 94501

( * ) Notice: Subject to any disclaimer, the term of this patent is extended or adjusted under 35 U.S.C. 154(b) by 0 days.

(21) Appl. No.: 10/337,916

(22) Filed: Jan. 6, 2003

(65) Prior Publication Data

US 2003/0154895 A1 Aug. 21, 2003

Related U.S. Application Data

(63) Continuation-in-part of application No. 09/722,830, filed on Nov. 27, 2000, now Pat. No. 6,502,523.

(51) Int. Cl.
*B63B 35/28* (2006.01)

(52) U.S. Cl. ..... 114/26; 114/61.1; 114/125; 114/344

(58) Field of Classification Search ..... 114/26, 114/61.15, 61.16, 61.17, 61.1, 344, 125, 362; 440/7, 11, 53
See application file for complete search history.

(56) References Cited

U.S. PATENT DOCUMENTS

| | | | | |
|---|---|---|---|---|
| 1,602,812 | A | | 10/1926 | Cook |
| 3,067,439 | A | | 12/1962 | Brush |
| 3,193,851 | A | | 7/1965 | Fiebelkorn |
| 3,332,388 | A | | 7/1967 | Moraski |
| 3,763,511 | A | | 10/1973 | Sisil |
| 3,828,719 | A | | 8/1974 | Cooke |
| 3,908,577 | A | | 9/1975 | Struyk |
| 3,987,748 | A | | 10/1976 | Carroll |
| 4,176,614 | A | * | 12/1979 | Goss et al. ..... 114/125 |
| 4,314,519 | A | | 2/1982 | Yunoki et al. |
| 4,621,385 | A | | 11/1986 | Gillois |
| 4,681,054 | A | | 7/1987 | Rice et al. |
| 4,697,967 | A | | 10/1987 | Schulz et al. |
| 4,736,702 | A | * | 4/1988 | Gubin ..... 114/353 |
| 5,111,763 | A | | 5/1992 | Moerbe |
| 5,607,330 | A | | 3/1997 | Hanz |
| 5,803,008 | A | * | 9/1998 | Georgens et al. ..... 114/293 |
| 6,022,068 | A | * | 2/2000 | D'Amico ..... 296/183.2 |
| 6,132,267 | A | | 10/2000 | Campbell |

* cited by examiner

*Primary Examiner*—Stephen Avila
(74) *Attorney, Agent, or Firm*—John P. O'Banion

(57) ABSTRACT

This invention is a road towed ferry with a hull system with a central hull and multiple outboard hulls having adjustable positions relative to the central hull. A first outboard hull position corresponds with a road tow configuration wherein the ferry may be towed over a road by a tow vehicle; the second position corresponds with a ferry configuration adapted to ferry the tow vehicle over water. The ferry in the tow configuration has a width, height, length, weight conforming with certain public road regulations without requiring special permits. In the ferry configuration the ferry is adapted to ferry heavy loads over water, such as in one configuration up to at least 16 tons, or in another configuration up to at least 19 tons.

44 Claims, 8 Drawing Sheets

ROAD TOWED FERRY

CROSS-REFERENCE TO RELATED APPLICATIONS

This application is a continuation-in-part of application Ser. No. 09/722,830 filed on Nov. 27, 2000 now U.S. Pat. No. 6,502,523, which is herein incorporated in its entirety by reference thereto.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable

BACKGROUND

1. Field of the Invention

This invention is a transportation vehicle. More specifically, it is a road towed ferry. Still more specifically, it is a road towed ferry that is adjustable between a stable ferry configuration for movement of a heavy land vehicle and/or substantial cargo across a body of water, and a road tow configuration for towing over roads by a tow vehicle.

2. Description of the Background Art

There are several existing ferry, barge and boat designs that contemplate amphibious operation. Several known examples of such a vehicle provide foldable boats with wheels, but do not generally provide appreciable load carrying ability, in particular with respect to ferrying heavy loads such as their own tow vehicle. Other known examples of such vehicles are transportable barges that can carry the towing car or motor home for recreation purposes. Some of these require the transported vehicle to provide the ferry propulsion, and in general their ferry capacity is limited. There are several larger barges and ferries that have also been previously disclosed that contemplate transporting heavy vehicles over water. These vessels generally have retractable wheels for ferry use and are generally not built for normal public road use, e.g. without requiring special permits, or for air transport in most viable airplanes.

Further more detailed examples of different types of vehicles, such as of the types just described, are variously disclosed in the following issued U.S. patents, each of which is incorporated herein by reference: U.S. Pat. No. 1,602,812 to Cook; U.S. Pat. No. 3,067,439 to Brush; U.S. Pat. No. 3,193,851 to Fiebelkorn; U.S. Pat. No. 3,332,388 to Moraski; U.S. Pat. No. 3,763,511 to Sisil; U.S. Pat. No. 3,908,577 to Struyk; U.S. Pat. No. 3,987,748 to Carroll; U.S. Pat. No. 4,314,519 to Yunoki et al.; U.S. Pat. No. 4,621,385 to Gillois; U.S. Pat. No. 4,681,054 to Rice et al.; and U.S. Pat. No. 4,697,967 to Shultz et al.

There is a significant demand for specialized ferry vehicles that provide the ability to ferry heavy loads over water, and to transport such a capable ferry over public roads without requiring special permits.

For example, such demand exists in heavy machinery applications, such as to transport mineral exploration and production equipment, in particular for example oil rig (or drilling) equipment, to remotely located sites over water without direct road access. These often are located over waterways having irregular depths, such as through marshlands. In such circumstances, "kedging" may often be required, using mechanical assistance such as winching onto stable structures pull the ferry forward, respectively. Or, motor driven wheels may be provided for shallow bottoms on certain amphibious vehicles, but generally are not provided for road-towed ferries.

In another example, military land vehicles such as tanks or other armored vehicles often require amphibious transport in order to reach remote locations over water. While some such vehicles may be equipped as amphibious vehicles themselves, designs that would otherwise be intended for primary land use would require significant modification with diminished land use armored vehicle capabilities. Therefore, many such armored vehicles require separate water transport assistance to ferry them over water when needed to reach a remote site.

One further more detailed example of such an armored vehicle that has been developed, according to at least one publication, is known as the "Stryker" family of light armored vehicles. According to this disclosure, the United States Army has disclosed its intention to deploy six brigades equipped with the new Strykers. One of them can fit onto a C-130 cargo plane, two on a C-17, and four on a C-5 plane. While there are at least ten variants of a common platform that have been disclosed for Strykers, the baseline Stryker is essentially an eight-wheeled, overgrown armored car. The target weight for Strykers is generally characterized as weighing about 38,000 pounds (19 tons), which nevertheless is considered a "light armor vehicle" compared to many other "heavy armor vehicles" such as tanks that may weigh as much as thirty to seventy tons.

The U.S. Army has further disclosed that it will spend $4 Billion to acquire 2,131 Strykers through 2008, when it will begin acquiring next generation vehicles. This plan has been published as part of a multi-year transformation that will produce lighter, faster armored vehicles that can be deployed quickly by air. One example of another such vehicle has been called the "Future Combat System (FCS)," to enable deployment of a combat-ready brigade anywhere in the world within 96 hours, a full division in 120 hours, and five divisions within 30 days. Seventy-ton tanks that require transportation aboard ships can't make the grade, but lighter, stronger, faster armored vehicles can. The newer FCS wheeled armored vehicles have been published to weigh no more than 16 tons each for easy air transportation. Accordingly, DARPA, the Pentagon's research arm, has been reported to be working with Boeing and Science Applications International Corporation to develop this next generation of FCS armored vehicles, intended to be ready for duty by 2012.

Notwithstanding the foregoing plans, such vehicles as the Strykers and FCS have not been disclosed to have any amphibious capabilities, and will still require water ferry support to reach many intended remote locations not readily accessible over land. Moreover, there would be much advantage to provide such a ferry that may be deployed in similar aircraft as these armored vehicles it is to transport. There would also be much advantage to adapt such ferry so that it may be towed by the armored vehicle during land transport to water launch sites. Still further, these armored vehicles are often transported between locations outside of combat situations, and there would be further advantage to adapting the ferry for road towing on public roads without requiring special permits. Further advantage would be gained if such ferry were readily adapted for kedging across shallow waterways or during waterway ingress or egress.

In particular, C-130 aircraft have been identified as a principal mode for armored vehicle transport such as for the Stryker and FCS light armored vehicles just described. The C-130 aircraft is characterized in one regard as beneficially adapted for landing on relatively short runways. Such aircraft's cargo capabilities have been disclosed, and include the following specifications: a width of no more than about 123 inches; a height of no more than about 9 feet; a length of no more than about 55.4 feet; and a total weight of no more than about 38,061 pounds. Another important heavy cargo transport aircraft, the C-17A, is characterized as having the following additional specifications for cargo capacity: a width of no more than about 18 feet; a height of no more than about 13 feet; and a length of no more than about 88 feet. Much benefit would be gained by providing a ferry that is adapted to ferry loads over water, such as for example loads up to at least about those corresponding with Stryker or FCS light armored vehicles, and also that is adapted to meet the specifications for air transport using similar planes.

With respect to road towing capabilities, public road regulations generally vary among different regions of the world, and in fact even among certain particular states in the United States, though national network roadways and interstate roadways have generally uniform standards. For example, for certain dual axle vehicles, the following are examples of specifications or limits that must be met for use on such roads, and most state roads complying with the interstate specifications, without requiring special permits: a width of no more than about 102 inches; a length of no more than about 48 feet; a total height of no more than about 14 feet, and a total weight of no more than about thirty four thousand pounds (17 tons).

Military transport of vehicles such as tanks or the light armored vehicles noted above is generally exempted from requiring permits for public highways. However, such regulations are in effect for reasons, such as public safety and roadway maintenance that are still beneficially met where possible. Moreover, there may be benefit in certain circumstances by not requiring such exemption for road transport.

There is still a need for a road towed ferry that is adapted to ferry heavy loads on water and also to be towed on public roads without requiring special permits.

There is also still a need for a road towed ferry that is adapted for air transport in certain highly utilized aircraft and also to ferry heavy loads on water.

There is also still a need for an improved road towed ferry that is has outboard hulls that are adjustable relative to a central hull between a first configuration for road towing or air transport and a second configuration for ferrying heavy loads.

There is also still a need for an improved road towed ferry that is readily adapted for kedging.

There is also still a need for a road towed ferry having a hull system capable of ferrying heavy loads over water, and that is configured to readily adjust such hull system into a more streamlined road tow configuration.

There is also still a need for a watercraft such as a road towed ferry with improved adjustability and stability between outboard hulls and a central hull.

BRIEF SUMMARY OF THE INVENTION

One object of the invention is to provide a road towed ferry that can be towed on land and ferry heavy vehicles and cargo afloat.

Another object of the invention is to provide a road towed ferry that can be launched and recovered from unimproved shorelines and traverse shallow water and submerged reefs and shoals to reach otherwise inaccessible locations.

Another object of the invention is to provide a road towed ferry that can be configured for towing on public highways without requiring special permits.

Another object of the invention is to provide a road towed ferry that is adapted to ferry heavy loads over water and also for transport in cargo aircraft. In one more specific regard, it is a further object of the invention to provide a road towed ferry that is adapted to ferry heavy loads weighing up to at least about 16 tons, and also to meet the requirements for transport in certain particular cargo transport aircraft, such as for example C-130 or C-17A aircraft in particular. Still more particularly, it is a further object to provide such ferry for use in transporting heavy construction and mining equipment and military vehicles, such as in particular tanks or other armored vehicles for example of the Stryker or FCS variety.

Another object of the invention is to provide a road towed ferry with an improved hull lock system between adjustable respective hulls of an adjustable hull system.

Another object of the invention is to provide a road towed ferry with an improved ability to kedge over shallow waterways or through other impediments to waterway transport.

Another object of the invention is to provide a road towed ferry with an improved gunwale system.

Another object of the invention is to provide a road towed ferry with an improved system for adjusting the positions of respective hulls of an adjustable hull system.

Another object of the invention is to provide a road towed ferry that is simple and cost effective to build, operate and/or maintain.

Another object of the invention is to provide a road towed ferry that is adapted to be towed by a tow vehicle and also to ferry the tow vehicle across water.

Another object of the invention is to provide an improved ferry for the safe and practical movement of cargo and vehicles across bodies of water and into otherwise inaccessible areas, and that is also converted for road towing by a tow vehicle.

Accordingly, one or more of the objects of the invention just described immediately above are generally met by each of the several aspects of the invention described immediately below, which are considered independently beneficial, as well as beneficial in their various combinations and sub-combinations as would be apparent to one of ordinary skill.

One aspect of the invention is a road towed ferry with a central hull, adjustable outboard hulls, and a ballast adjusting system, and that is adapted to incorporate a propulsion system to transport a variety of vehicles and loads over water.

Another aspect of the invention is a road towed ferry with a wheel assembly equipped for road towing, launching, kedging and landing.

A further aspect of the invention is a road towed ferry that is adapted to ferry heavy vehicles and cargo while meeting requirements for operation on U.S. public highways without special permits.

Another aspect of the present invention is a road towed ferry that is adjustable between first and second configurations, wherein in the first configuration the ferry is adapted to ferry heavy vehicles and cargo on water, and in the second configuration the ferry is adapted to have certain dimensions and weight sufficient to meet space and weight requirements for C-130 or C-17A aircraft transport.

Another aspect of the invention is a road towed ferry with a central hull and a plurality of outboard hulls that are adjustable relative to said central hull between a road tow configuration and a ferry configuration. In the road tow configuration the ferry is adapted to be towed on a road by a tow vehicle, whereas in the ferry configuration the ferry is adapted to ferry on water a load of up to at least about 16 tons, which weight corresponds with for example certain light armored vehicles that may thus be transported over water by this ferry.

According to one mode of this aspect, the ferry configuration the ferry is adapted to ferry on water a load of up to at least about 19 tons, which weight corresponds for example with the load of Stryker vehicles.

According to another mode, in the road tow configuration the ferry has a width of no more than about 102 inches, a length of no more than about 48 feet, a total height of no more than about 14 feet, and a total weight of no more than about thirty four thousand pounds. The ferry meeting these specifications is in particular adapted to be transported over national public highways without requiring special permits, e.g. per tandem axle configurations.

According to another mode, in the road tow configuration the ferry has a width of no more than about 123 inches, a height of no more than about 9 feet, a length of no more than about 55.4 feet, and a total weight of no more than about 38,061 pounds. Accordingly, the ferry with these dimensions is adapted to be transported in C-130 transport aircraft.

According to another mode, in the road tow configuration the ferry has a width of no more than about 18 feet, a height of no more than about 13 feet, and a length of no more than about 88 feet. The ferry according to these specifications is well suited for transport in C17A transport aircraft.

According to another mode, the ferry further includes a kingpost that is adapted to move said plurality of outboard hulls between the ferry configuration and the road tow configuration.

In another mode, the ferry further includes a ballast system that is adapted to change the center of gravity of said ferry longitudinally and laterally in the ferry configuration.

In still a further mode, the ferry further includes a plurality of hinged gunwales coupled to said plurality of outboard hulls.

According to yet another mode, in the ferry configuration the ferry is further adapted to ferry on water a towing vehicle that is adapted to tow the ferry in the tow configuration.

In another mode in the ferry configuration, a top surface of the central hull is adapted to carry a load, and the outboard hulls are also adapted to carry a load.

Further to still another mode, a kedging winch is also provided that is adapted to assist the ferry in kedging in the ferry configuration.

In another mode, a wheel assembly is coupled to said central hull. According to one embodiment of this mode, the wheel assembly at least in the ferry configuration is substantially non-retractable.

Another aspect of the invention is a road towed ferry that includes a hull system that is adjustable between a tow configuration and a ferry configuration. In the tow configuration, the ferry has a width of no more than about 102 inches, a length of no more than about 48 feet; a height of no more than about 14 feet; and a total weight of about thirty four thousand pounds or less. In the ferry configuration the ferry is adapted to ferry over water a heavy load of up to at least about 16 tons, which weight corresponds for example with certain particular light armor vehicles.

According to one mode of this aspect, in the tow configuration the ferry has a width of no more than about 123 inches, a height of no more than about 9 feet, a length of no more than about 55.4 feet, and a total weight of no more than about 38,061 pounds. This mode is particularly well suited for C-130 aircraft transport.

According to another mode in the tow configuration, the ferry has a width of no more than about 18 feet, a height of no more than about 13 feet, and a length of no more than about 88 feet. This mode is particularly well suited for C-17A aircraft transport.

In still a further mode, the ferry configuration the ferry is adapted to ferry over water a load of up to at least about 19 tons, which weight corresponds therefore to the ability to transport for example certain armored vehicles such as of the STRYKER variety.

Another aspect of the invention is a road towed ferry with a hull system that is adjustable between a road tow configuration and a ferry configuration. In the road tow configuration the ferry has a width of no more than about 123 inches, a height of no more than about 9 feet, a length of no more than about 55.4 feet, and a total weight of no more than about 38,061 pounds. In the ferry configuration, the ferry is adapted to ferry over water a load of up to at least about 16 tons. Such arrangement thus allows for example the ferry to be transported on C-130 aircraft, and also to ferry over water such loads as are predicted for certain light armored vehicles, and in particular such vehicles also shipped in the C-130 aircraft.

According to one mode of this aspect in the road tow configuration, the ferry comprises a width of no more than about 102 inches, a length of no more than about 48 feet, a total height no more than about 14 feet, and a total weight of no more than about thirty four thousand pounds. This construction thus allows the ferry to be transported on most public roads such as national network highways.

According to another mode in the ferry configuration, the ferry is adapted to ferry over water a load of up to at least about 19 tons, a load equivalent for example to certain particular armored vehicles such as of the STRYKER variety.

According to another mode, the hull system includes a central hull and a plurality of outboard hulls that are adjustable between first and second respective positions relative to the central hull that correspond with the road tow configuration and the ferry configuration, respectively.

Another aspect of the invention is a road towed ferry with a hull system and a substantially non-retractable wheel assembly coupled to the hull system. The hull system is adjustable between a road tow configuration and a ferry configuration as follows. In the road tow configuration the ferry is adapted to be towed on a road by a tow vehicle. In the ferry configuration the ferry is adapted to ferry over water a load of up to at least about 16 tons.

According to one further mode of this aspect, the ferry in the ferry configuration is adapted to ferry a load of up to at least about 19 tons over water.

According to another mode of this aspect in the road tow configuration the ferry has a width of no more than about 102 inches, a length of no more than about 48 feet, a height of no more than about 14 feet, and a total weight of no more than about thirty four thousand pounds. Such configuration is in particular useful for transport on most public highways without requiring special permits.

According to another mode of this aspect in the road tow configuration, the ferry has a width of no more than about 123 inches, a height of no more than about 9 feet, a length of no more than about 55.4 feet, and a total weight of no more than about 38,061 pounds.

In still a further mode, the ferry in the road tow configuration has a width of no more than about 18 feet, a height of no more than about 13 feet, and a length of no more than about 88 feet.

According to another mode, the hull system of the ferry includes a central hull that cooperates with a plurality of outboard hulls as follows. The outboard hulls are adjustable relative to the central hull between first respective positions and second respective positions. These first and second positions correspond to the road tow and ferry configurations, respectively.

According to another mode, the wheel assembly has at least two axles. In another mode, the wheel assembly has at least three axles.

Another aspect of the invention is a road towed ferry with an adjustable hull system, a wheel assembly coupled to said hull system, and at least one motor coupled to the wheel assembly. The hull system is adjustable between a road tow configuration and a ferry configuration as follows. In the road tow configuration the ferry is adapted to be towed on a road by a tow vehicle. In the ferry configuration the ferry is adapted to ferry a load over water.

According to one mode of this aspect in the road tow configuration, the ferry has a width of about 102 inches or less, a length of about 48 feet or less, a height of 14 feet or less, and a total weight of about thirty four thousand pounds or less.

According to another mode in the road tow configuration, the ferry has a width of about 123 inches or less, a height of about 9 feet or less, a length of about 55.4 feet or less, and a total weight of about 38,061 pounds or less.

In a further mode, in the road tow configuration the ferry has a width of about 18 feet or less, a height of about 13 feet or less, and a length of about 88 feet or less.

In another mode, the hull system includes a central hull and a plurality of outboard hulls that are adjustable relative to the central hull between first and second respective positions. These first and second positions correspond to the road tow and ferry configurations, respectively.

According to another mode, the wheel assembly includes at least two axles, whereas in another mode the wheel assembly has at least three axles.

In still further modes, the motor in one regard is electric, whereas the motor in another regard may be hydraulic.

Another aspect of the invention is a road towed ferry that includes a hull system in combination with a ballast system. The hull system is adjustable between a road tow configuration, wherein the ferry is adapted to be towed on a road by a tow vehicle, and a ferry configuration, wherein the ferry is adapted to ferry a load over water. The ballast system cooperates with the hull system and is adapted to change the center of gravity of said ferry longitudinally and laterally in the ferry configuration.

According to one mode of this aspect, in the road tow configuration the ferry has a width of about 123 inches or less, a height of about 9 feet or less, a length of about 55.4 feet or less, and a total weight of about 38,061 pounds or less.

In another mode with respect to the road tow configuration, the ferry has a width of about 18 feet or less, a height of about 13 feet or less, and a length of about 88 feet or less.

According to still another mode of this aspect, in the road tow configuration the ferry has a width of about 102 inches or less, a length of about 48 feet or less, a total height of about 14 feet or less, and a total weight of about thirty four thousand pounds or less. Further to this mode, in the ferry configuration the ferry is also adapted to ferry a load of up to at least about 16 tons over water, and is adapted in further embodiments to ferry a load of up to at least about 19 tons over water.

In another mode, the ferry includes a central hull and outboard hulls that are adjustable relative to the central hull between first and second respective positions. The first and second positions correspond to the road tow and ferry configurations, respectively.

Another aspect of the invention is a road towed ferry with a central hull and multiple outboard hulls, in addition to a hydraulic ballast system. The outboard hulls are adjustable relative to the central hull between first and second respective positions that correspond with a road tow configuration and a ferry configuration for the ferry, respectively. In the road tow configuration the ferry is adapted to be towed on a road by a tow vehicle, whereas in the ferry configuration the ferry is adapted to ferry over water the tow vehicle. The hydraulic ballast system according to this aspect is adapted to change the center of gravity of said ferry longitudinally and laterally in the ferry configuration.

According to one mode of this aspect, in the road tow configuration the ferry has a width of about 123 inches or less, a height of about 9 feet or less, a length of about 55.4 feet or less, and a total weight of about 38,061 pounds or less.

According to another mode in the road tow configuration, the ferry has a width of about 18 feet or less, a height of about 13 feet or less; and a length of about 88 feet or less.

In still a further mode, in the road tow configuration the ferry has a width of about 102 inches or less, a length of about 48 feet or less, a total height of about 14 feet or less, and a total weight of about thirty four thousand pounds or less. Further to this mode, in the ferry configuration the ferry is adapted to ferry a load of up to at least about 16 tons over water.

In still a further mode, in the ferry configuration the ferry is adapted to ferry a load of up to at least about 19 tons over water.

Another aspect of the invention is a road towed ferry with a hull system and a gunwale system coupled to the hull system. The hull system is adjustable between a road tow configuration and a ferry configuration as follows. In the road tow configuration the ferry is adapted to be towed over a road by a tow vehicle, whereas in the ferry configuration the ferry is adapted to ferry a load over water.

In one mode of this aspect, the gunwale system includes a plurality of discrete adjustable gunwales coupled to said hull system, which together form a substantial barrier around a perimeter area of the hull system.

In one mode of this aspect, in the road tow configuration the ferry has a width of about 102 inches or less, a length of about 48 feet or less, a total height of about 14 feet or less, and a total weight of about thirty four thousand pounds or less.

In another mode, in the road tow configuration the ferry has a width of about 123 inches or less, a height of about 9 feet or less, a length of about 55.4 feet or less, and a total weight of about 38,061 pounds or less.

In another mode, in the road tow configuration the ferry has a width of about 18 feet or less, a height of about 13 feet or less, and a length of about 88 feet or less. In a further embodiment according to any or all of the dimensional modes just described, in the ferry configuration the ferry is adapted to ferry a load of up to at least about 16 tons over water. In still a further variation of this embodiment, the ferry is adapted to ferry a load of up to at least about 19 tons over water.

Another aspect of the invention is a watercraft with an adjustable hull system and a hull lock system. The adjustable hull system has a central hull and an outboard hull that is adjustable relative to the central hull between first and second positions. The hull lock system cooperates with the central hull and outboard hull and includes a protrusion and a cooperating receiver. One of the protrusion and receiver is located on the central hull, whereas the other of the protrusion and receiver is located on the outboard hull. The protrusion and receiver are adapted to be engaged in the first position and to be disengaged in the second position.

According to one mode of this aspect, the receiver is a keyway fitting that is adapted to receive the protrusion in a lock-and-key relationship.

In another mode, the hull system includes multiple outboard hulls that are each adjustable relative to the central hull between respective first and second positions. Further to this mode, more than one of the hull lock systems are provided, such that each of the outboard hulls cooperates with at least one of said hull lock systems with respect to the central hull.

In still a further mode, the first and second positions for the outboard hull correspond with ferry and road tow configurations, respectively, as follows. In the ferry configuration the watercraft is adapted to ferry a load over water, whereas in the road tow configuration the watercraft is adapted to be towed over a road with a tow vehicle. Accordingly, such watercraft having these features is thus well adapted for use as a road towed ferry.

Another aspect of the invention is a road towed ferry with a hull system having a central hull and multiple outboard hulls with means for adjusting the outboard hulls relative to the central hull between road tow and ferry configurations. In the road tow configuration the ferry is adapted to be towed on a road by a tow vehicle, whereas in the ferry configuration, the ferry includes means for ferrying up to at least about 16 tons.

Another aspect of the invention is a road towed ferry with a hull system and means for adjusting the hull system between a tow configuration and a ferry configuration as follows. In the road tow configuration the ferry is adapted to be towed on a road by a tow vehicle and has a width of about 102 inches or less, a length of about 48 feet or less, a height of about 14 feet or less, and a total weight of about thirty four thousand pounds or less. In the ferry configuration, the ferry includes means for ferrying a load of up to at least about 16 tons over water.

Another aspect of the invention is a road towed ferry with a hull system and means for adjusting the hull system between a road tow configuration and a ferry configuration such that in the road tow configuration the ferry has a width of about 123 inches or less, a height of about 9 feet or less, a length of about 55.4 feet or less, and a total weight of about 38,061 pounds or less.

In one further mode of this aspect, the ferry in the ferry configuration includes means for ferrying a load of up to at least 16 tons over water, whereas in a further embodiment of such mode the means for ferrying a load supports up to at least 19 tons over water.

Another aspect of the invention is a road towed ferry with a hull system, means for adjusting the hull system between a road tow configuration and a ferry configuration, and a wheel assembly with means for non-retractably coupling the wheel assembly to the hull system. In the ferry configuration the ferry further includes means for ferrying a load of up to at least about 16 tons over water.

Another aspect of the invention is a road towed ferry with a hull system, means for adjusting the hull system between a road tow configuration and a ferry configuration, and a wheel assembly coupled to the hull system, and means for applying power to said wheel assembly. In one mode of this aspect, the means for applying power to the wheel assembly includes means for coupling a motor to the wheel assembly.

Another aspect of the invention is a road towed ferry with a hull system, means for adjusting the hull system between a road tow configuration and a ferry configuration, for adjusting the hull system between a road tow configuration and a ferry configuration, and a means for changing the center of gravity of said ferry longitudinally and laterally in the ferry configuration. In one mode of this aspect, the means for changing the center of gravity includes a means for ballasting the ferry. In a further embodiment of such mode, the means for ballasting includes a hydraulic ballast system.

Another aspect of the invention is a road towed ferry with a central hull, multiple outboard hulls, means for adjusting the multiple outboard hulls between first and second respective positions relative to the central hull corresponding to road tow and ferry configurations for the ferry, respectively, and means for hydraulically changing the center of gravity of the ferry longitudinally and laterally in the ferry configuration. In one mode of this aspect, the means for hydraulically changing the center of gravity of the ferry includes a means for hydraulically ballasting the ferry.

Another aspect of the invention is a road towed ferry with a hull system, means for adjusting the hull system between a road tow configuration and a ferry configuration, and a means for coupling gunwales to the hull system.

Another aspect of the invention is a watercraft with a hull system that has a central hull and an outboard hull with means for adjusting the outboard hulls relative to the central hull between first and second positions corresponding to road tow and ferry configurations, respectively. This aspect further includes a means for locking the position of the outboard hulls relative to the central hull in the ferry configuration. One mode of this aspect, the means for locking the hulls includes a means for removably engaging a protrusion with a receiver. In a further embodiment of this mode, the means and receiver in relatively fixed positions along opposite adjoining hulls. In another mode, one of the protrusion and receiver is located on the central hull and the other of the protrusion and receiver is located on an outboard hull. This mode further includes means for engaging the protrusion with the receiver in the first position and means for disengaging them in the second position.

Another aspect of the invention is a road transport system that includes an armored vehicle having a weight of at least about 16 tons, and a ferry that cooperates with the armored vehicle. The ferry is adjustable between a road-tow configuration and a ferry configuration as follows. In the road tow configuration the ferry is adapted to be towed over a road by the armored vehicle; whereas in the ferry configuration the ferry is adapted to ferry the armored vehicle over water.

According to one further mode of this aspect, the armored vehicle weighs at least about 19 tons.

According to another mode, the road towed ferry in the road tow configuration is characterized as having a width of about 102 inches or less, a length of about 48 feet or less, a total height of about 14 feet or less, and a total weight of about thirty four thousand pounds or less. In another mode, the ferry in the road tow configuration has a width of about 123 inches or less, a height of about 9 feet or less, a length of about 55.4 feet or less, and a total weight of about 38,061 pounds or less. In still a further mode, in the road tow configuration the ferry has a width of about 18 feet or less, a height of about 13 feet or less, and a length of about 88 feet or less.

Another aspect of the invention is a road towed ferry with a hull system, a wheel system, a kedging winch, a ballast system, a gunwale system, and a propulsion system.

According to one mode of this aspect, the hull system includes a central hull and a plurality of outboard hulls that are each adjustable between first and second respective positions that correspond with road tow and ferry configurations for the ferry. According to another mode, the wheel system is coupled to a central hull of the hull system. According to another mode, the kedging winch is coupled to the central hull. In another mode, the ballast system is coupled to the hull system and adapted to adjust the center of gravity of the ferry in a ferry configuration. In still a further mode, the gunwale system cooperates with the hull system and includes a plurality of gunwales that each has an adjustable position between the road tow and ferry configurations for the road towed ferry. In yet another mode, the propulsion system cooperates with the hull system. According to still further modes, the ferry has a road tow configuration that is adapted to be towed over a road by a tow vehicle, and a ferry configuration wherein the ferry is adapted to ferry a load of up to at least about 16 tons over water. According to a further embodiment of this mode, in the ferry configuration the ferry is adapted to ferry a load of up to at least about 19 tons over water.

Additional aspects of the invention include various methods of manufacturing and use consistent with the apparatus and system aspects described above and by further reference to the detailed embodiments below, such as for example in particular regard to towing a ferry over a road and ferrying a substantially heavy load with the ferry over water.

Further aspects of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF INVENTION

Figure 1:
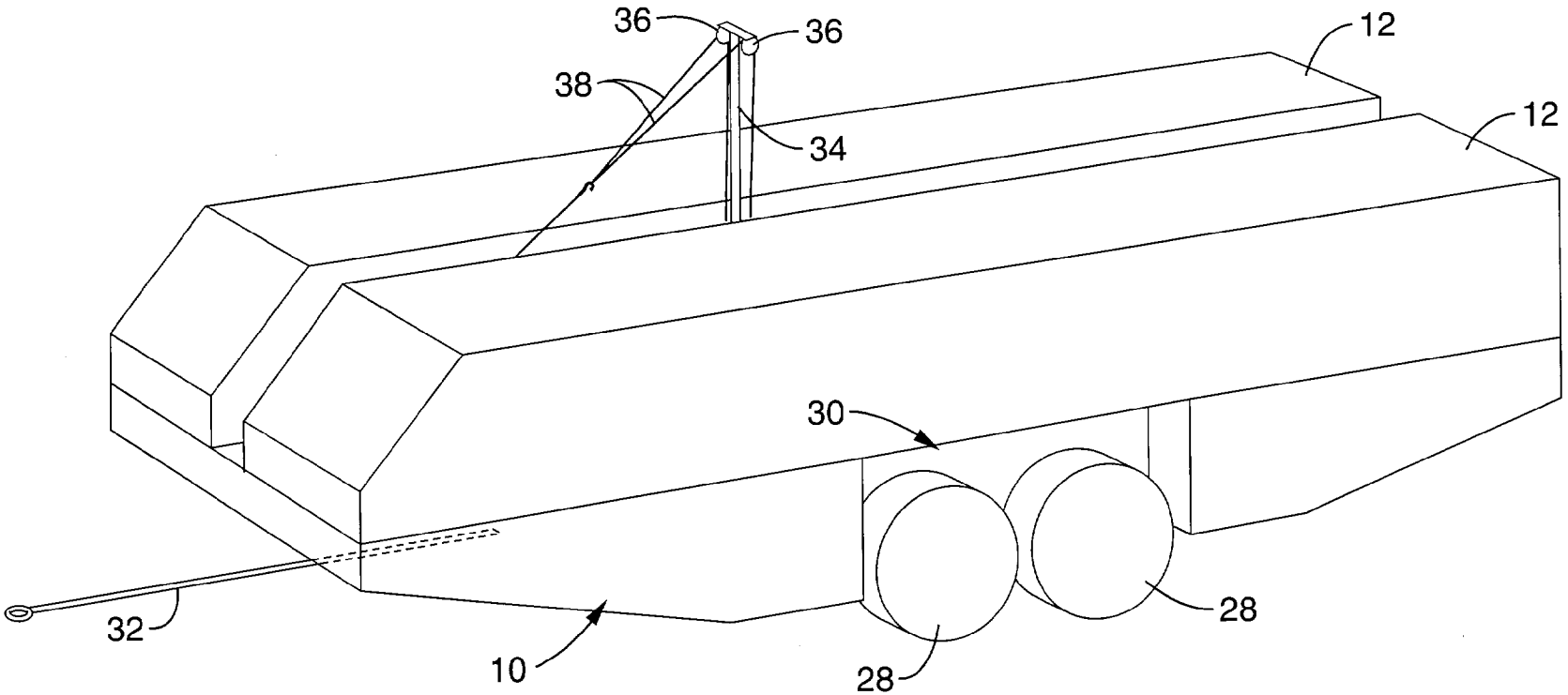
FIG. 1 is a perspective view showing the bow, port side, and top, of a ferry embodiment of the invention in its land mode of operation.

Referring more specifically to the drawings, for illustrative purposes the present invention is embodied according to one embodiment (and various beneficial but optional features) generally shown in FIG. 1 through FIG. 8. Moreover, further embodiments, and appreciation for the broad scope of certain aspects of the invention with respect to the various embodiments, are illustrated in FIGS. 9–14. It will be appreciated that the apparatus may vary as to configuration and as to details of the parts, and that the method may vary as to the specific steps and sequence, without departing from the basic concepts as disclosed herein.

The following is a list of reference numerals generally used herein by reference to like numerals provided in the FIGS.:

| | |
|---|---|
| 10 | central hull |
| 12 | outboard hulls |
| 14 | main frame |
| 16 | heavy frame |
| 18 | forward flotation compartment |
| 20 | outer flotation compartments |
| 22 | aft flotation compartment |
| 24 | suspension systems |
| 26 | axles |
| 28 | pneumatic-tired wheels |
| 30 | wheel wells |
| 32 | towing tongue |
| 34 | kingpost |
| 36 | snatch blocks |
| 38 | wire-rope bridle |
| 40 | winch |
| 41 | winch compartment |
| 42 | bow compartment |
| 44 | mast |
| 46 | anchor light |
| 48 | radar transceiver |
| 50 | masthead light |
| 52 | locking mast pivot |
| 54 | mast-stabilizing bipod |
| 56 | mast-stabilizing strut |
| 58 | control/display panel |
| 60 | machinery compartment |

-continued

| | |
|---|---|
| 62 | stern compartment |
| 64 | lifeline posts |
| 66 | port and starboard lifelines |
| 68 | stern lifeline |
| 70 | starboard vehicle ramp |
| 72 | central-hull bow gunwale |
| 74 | outboard-hull gunwales |
| 76 | central-hull stern gunwale |
| 78 | hull-lock access wells |
| 80 | hull locks |
| 82 | tongue pin access well |
| 84 | tongue pin |
| 86 | fathometer transducer |
| 88 | water-ballast pump |
| 90 | propulsion/steering units |
| 92 | battery bank |
| 94 | forward water-ballast tanks |
| 96 | main fuel tank |
| 98 | outer fuel tanks |
| 102 | aft water-ballast tanks |
| 104 | hull-lock "keyholes" |
| 106 | tongue housing |
| 108 | tongue housing/main frame forward junction |
| 110 | tongue housing/ main frame aft junction |
| 112 | alternative towing tongue |
| 114 | alternative central hull |
| 116 | port alternative outboard hull |
| 118 | port inflatable bellows |
| 120 | secondary outboard hull |
| 122 | hull hinge |
| 124 | outboard inflatable bellows |
| 126 | outboard bellows cover plate |
| 128 | motor |

As elsewhere herein described, the road-towed ferry of the present invention comprises various highly beneficial novel aspects in combination with numerous conventional items and installations. Many such conventional features are generally familiar to persons skilled in the arts of boat and trailer construction and cargo handling. As such, various materials, equipment, and construction/installation features and methods pertaining to the ferry of the invention may be suitable according to various industry standards and legal requirements governing road and water transport. Accordingly, certain such requirements governing road and water transport. Accordingly, certain such items and installations may not be herein described or shown in detail, but may be considered a part of the invention as they pertain to the various embodiments herein shown and described. Such items may be drawn in idealized form or merely their positions outlined; or for example may be summarily referred to in the text below.

For further understanding, the following are examples, without limitation, of certain items and installations pertaining to the ferry of the present invention which may be indicated and/or incorporated with the various embodiments of the present ferry, though such may not be herein shown or described in detail by reference to a particular embodiment:

(a) tires, wheels, brakes, axles, suspension systems, and "road" lights;

(b) radar, fathometer, winch, battery bank, water-jet propulsion/steering units, water-ballast pump, control/display panel with umbilical cord, and navigation lights;

(c) wiring, piping, and associated components, tank baffles, sacrificial anodes, reinforcing plates and gussets, flotation foam, hinges and pivots, vehicle ramps, hatches and cover plates, securing devices, deck cleats and fairleads, mooring lines, anchors, various rigging, towing tongue, alternate-embodiment towing tongue and inflatable bellows, and installation sockets of the mast, mast-stabilizing bipod, mast-stabilizing strut, lifeline posts, and kingpost; and (d) items related to operation in various modes of use of the invention, such as a tow vehicle, on-board loads such as vehicles and equipment, a lever-action chain binder, rigging points on the outboard hulls, and a dinghy.

The following is an exemplary description of particular modes of construction for the ferry of the invention, by general reference to the Figures. Metric dimensions provided are generally rounded to the nearest millimeter.

By general reference to the FIGS. (e.g. FIGS. 1–7), the ferry's central hull 10 and outboard hulls 12 are primarily constructed according to one beneficial exemplary embodiment of welded-together aluminum plate and hollow aluminum framework. Conventional sacrificial anodes are installed near contacting dissimilar metals to inhibit galvanic corrosion. Exemplary plate material considered suitable for such use may be for example about 6 mm (¼ inch) thick, or may be about 3 mm (⅛ inch) thick. To simplify the text, such plate will respectively be called "heavy" or "light."

Heavy plate is generally used where load-bearing strength and/or resistance to damage is desired. Such areas may include for example tank and compartment walls shown in the drawings and all external surfaces of the ferry in its water mode. Light plate is generally used for example for tank baffles and minor compartment walls (none shown).

Likewise, framework generally useful for constructing a ferry of the invention will be herein generally called "heavy" or "light". Specific dimensions considered generally suitable for such materials generally include for example (respective to heavy or light): about 6 mm (¼ inch) wall and about 51 mm by about 51 mm (2 inch by 2 inch) cross-section, or about 3 mm (⅛ inch) wall and about 25 mm by about 25 mm (1 inch by 1 inch) cross-section. Main frame 14 (e.g. FIG. 7) in one suitable embodiment may have a wall thickness of about 13 mm (½ inch) and cross-section of about 76 mm by about 152 mm (3 inch by 6 inch).

Figure 6:
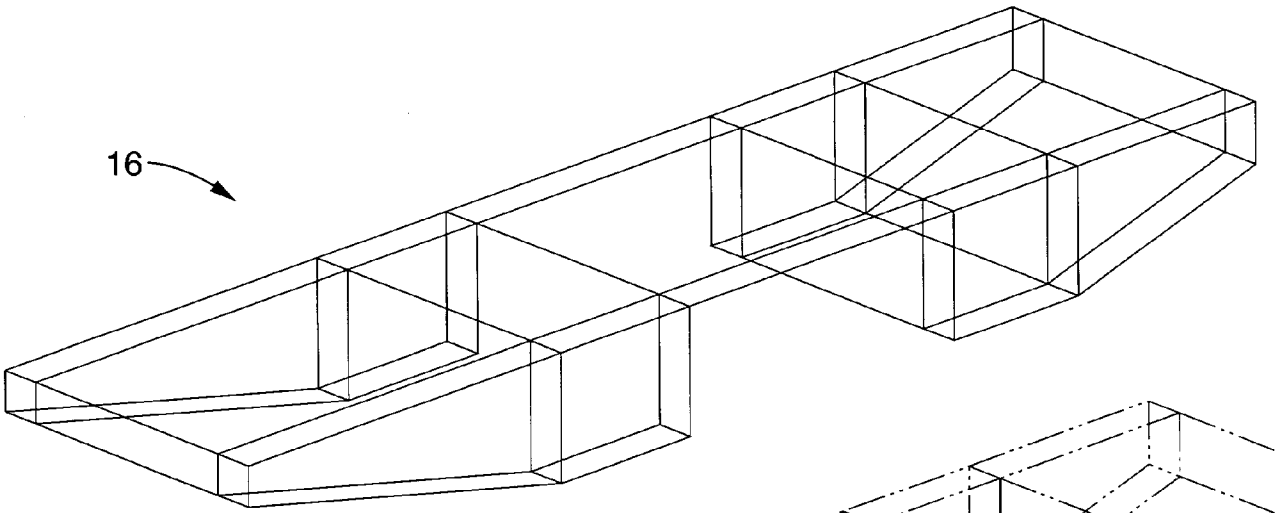
FIG. 6 is a dimetric line-diagram showing the arrangement of the central hull heavy frame.
Figure 7:
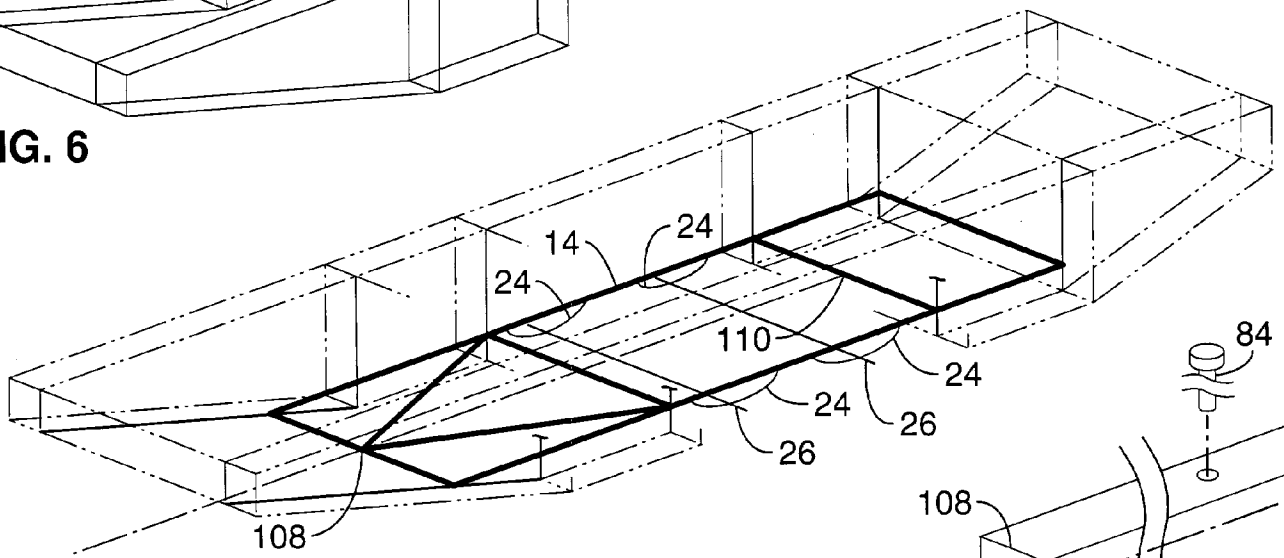
FIG. 7 is a dimetric line-drawing showing the arrangement of the main frame and members of the central hull heavy frame to which the main frame is attached.

The main frame and heavy frame 16, as shown in FIG. 6 and portions shown in FIG. 7, are generally adapted to resist torsion, tension, and compression. The heavy frame also secures most tank and compartment walls shown in the drawings. Light frames primarily secure tank baffles and minor compartment walls (none shown).

Flotation compartments 18, 20, and 22 (FIG. 4), and outboard hulls contain closed-cell foam which solidifies after being installed in a fluid state.

Various aspects of the invention are further exemplified by reference to the embodiments shown in FIGS. 1–8 as follows. For clarity and simplicity, various items are omitted from drawing figures, and removable equipment is shown installed but not stowed (e.g., mast stabilizing members). Whereas certain omitted items would have been visible in more than one Figure, certain such items not shown in detail include for example: hatches and cover plates; installation sockets (which may be located beneath the ferry's upper deck surface) of the kingpost; lifeline posts; mast-stabilizing strut; and hinges connecting the central hull and outboard hulls.

Other items omitted from certain figures where they would have been visible will be pointed out in other figures, such as according to aspects of the following additional description. Some items mentioned in the discussion of a figure may be also shown, or only shown, elsewhere.

The following is a description of certain beneficial features of the invention by general reference to FIG. 1 that shows a perspective view of the road-towed ferry in its land mode, including the top, port side, and bow. Hull locks are considered beneficially included according to various further embodiments, though not shown in this view. Reference to other relevant Figures with respect to particular such features is also generally provided for further understanding in parentheses.

Figure 3:
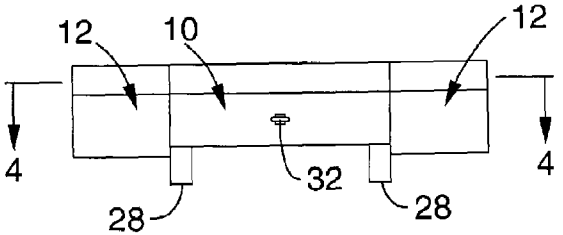
FIG. 3 is an orthogonal bow view of the outboard hulls, central hull, and wheels, in the ferry's water mode of operation.
Figure 4:
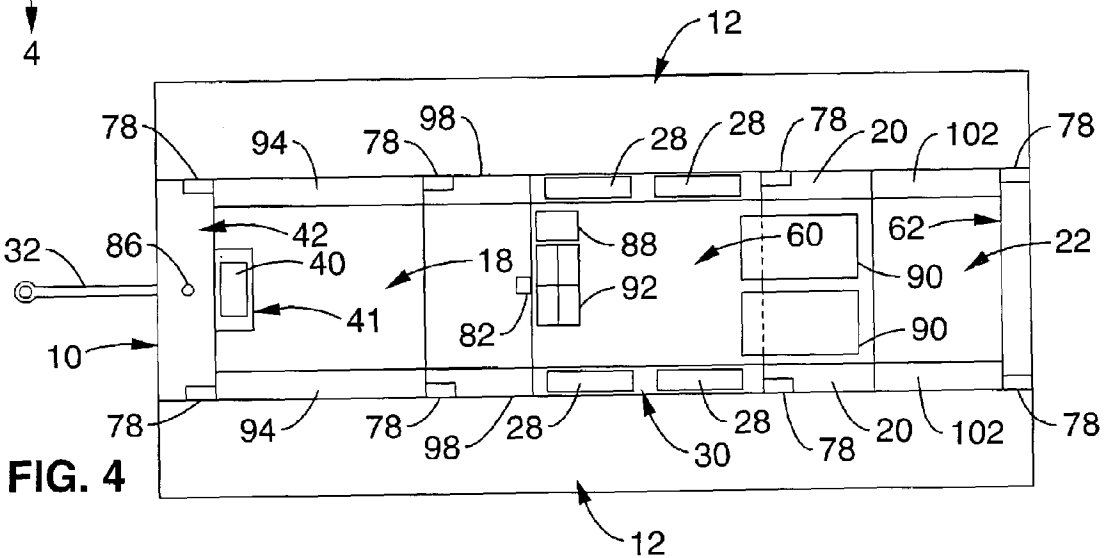
FIG. 4 is an orthogonal, cut-away top view of the ferry in its water mode, the upper deck being omitted as indicated by line 4—4 in FIG. 3.
Figure 5:
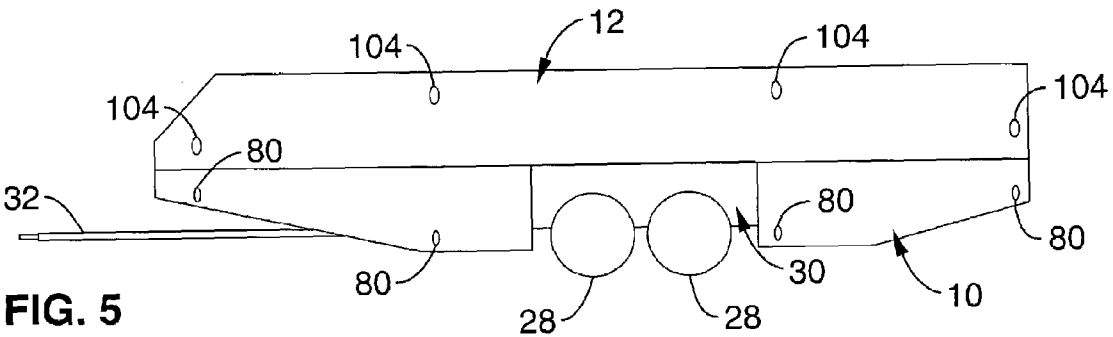
FIG. 5 is an orthogonal port-side view of a ferry embodiment of the invention in its land mode of operation.

Central hull 10 (also shown in FIGS. 2–5) is attached by suspension systems 24 (shown in FIG. 7) to axles 26 (only FIG. 7), on which are shown port pneumatic-tired wheels 28 (also shown in FIGS. 3–5) within port wheel well 30 (also shown in FIGS. 4 and 5).

Extending from the bow is retractable towing tongue 32 (also shown in FIGS. 3, 4, 5, and 8). Outboard hulls 12 (also FIGS. 2, 3, 4, and 5), carried atop the central hull, are attached by hinges along the upper outboard edges of the central hull deck. Kingpost 34 is shown in position to deploy the outboard hulls using snatch blocks 36, wire-rope bridle 38, and a cable from winch 40 (only FIG. 4).

Figure 2:
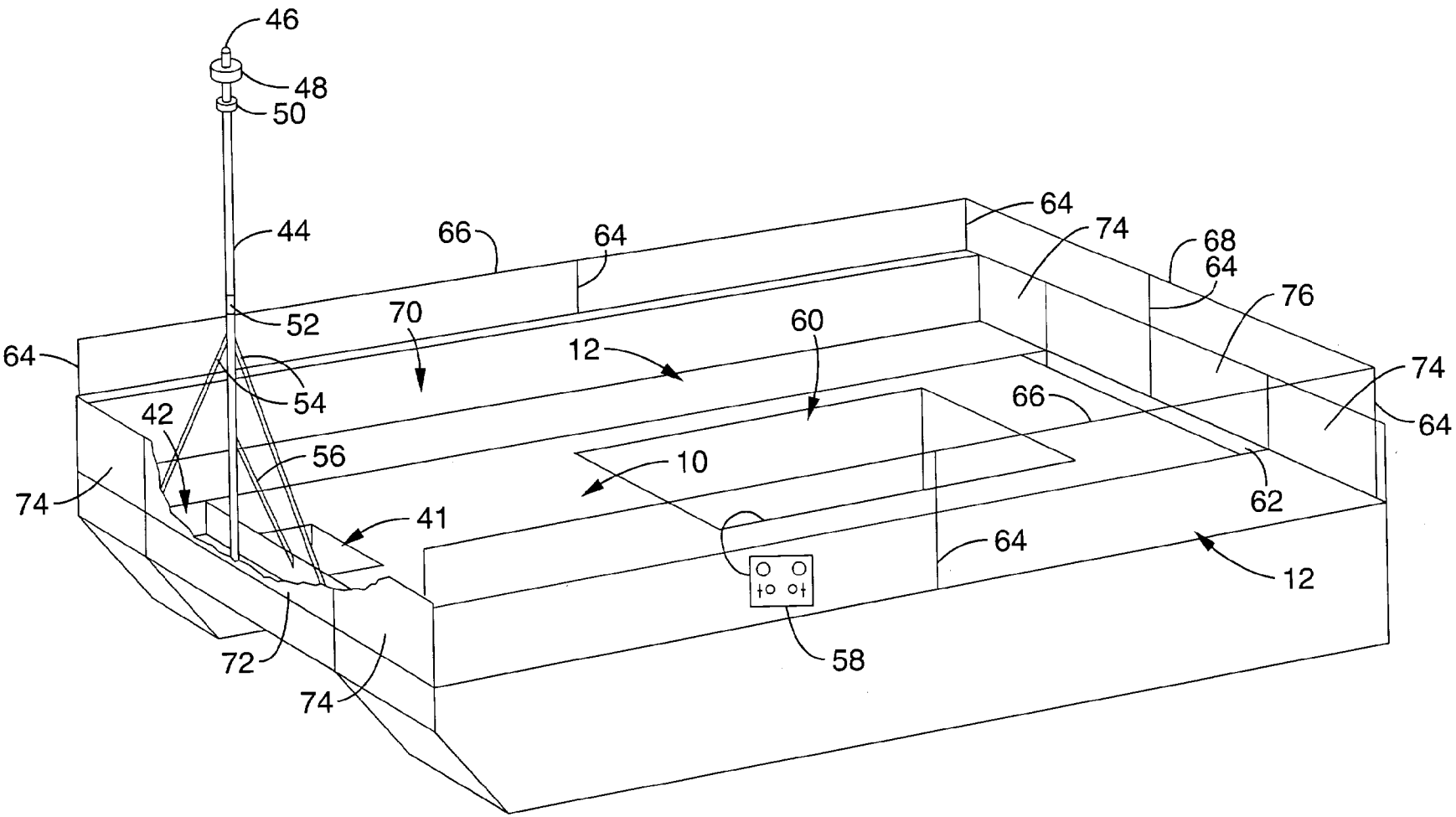
FIG. 2 is a perspective view showing the bow, port side, and top of a ferry embodiment of the invention in its water mode of operation.

FIG. 2 is similar to FIG. 1, but shows the ferry in its water mode. Items contemplated for beneficial inclusion with the overall assembly shown, according to certain further variations, but are not shown (or at least not in detail), include below-deck equipment (e.g. FIG. 4) and members of heavy frame 16 (e.g. FIGS. 6–7), which would generally be visible through the hatches with the hatch covers omitted in the depiction of FIG. 2.

Various of the features shown in FIG. 2 include central hull 10 (also FIGS. 1, and 3–5), hinged outboard hulls 12 (also FIGS. 1, and 3–5), winch compartment 41 (also FIG. 4), bow compartment 42 (also FIG. 4), mast 44, anchor light 46, radar transceiver 48, masthead light 50, locking mast pivot 52, mast stabilizing bipod 54, mast-stabilizing strut 56, control/display panel with umbilical cord 58, machinery compartment 60 (also FIG. 4), stern compartment 62 (also FIG. 4), lifeline posts 64, port and starboard lifelines 66, and stern lifeline 68 (bow lifeline not shown).

Starboard vehicle ramp 70 is fastened to lifeline posts on the starboard side (port ramp not shown). Fastened to the mast and lifeline posts are central hull bow hinged gunwale 72, outboard hull hinged gunwales 74, and central hull stern hinged gunwale 76, (portions omitted and hinges not shown).

FIG. 3 shows an orthogonal, water-mode bow view of central hull 10, (also FIGS. 1, 2, 4, and 5), hinged outboard hulls 12 (also FIGS. 1, 2, 4, and 5), retractable towing tongue 32 (also FIGS. 1, 4, 5, and 8), and wheels 28 (also FIGS. 1, 4, and 5).

FIG. 4 shows an orthogonal, cut-away top view of the ferry in its water mode. The upper deck is omitted as indicated by line 4—4 in FIG. 3. Axles 26 (see FIG. 7) which would have been marginally visible are omitted, as are tank baffles, installation sockets of the mast and mast stabilizing bipod, and all frame members. Closed-cell foam may be installed according to certain beneficial embodiments, but is not shown, in forward flotation compartment 18, outer flotation compartments 20, aft flotation compartment 22, and outboard hulls 12 (also FIGS. 1–3, and 5).

Walls of tanks and compartments are shown, as are access wells 78 of hull locks 80 (FIG. 5), access well 82 of tongue-securing pin 84 (FIG. 8), fathometer transducer 86, and retractable towing tongue 32 (also FIGS. 1, 3, 5, and 8). Central hull 10 (also FIGS. 1–3, and 5) is indicated by a lead line with an arrowhead to distinguish it from tanks and compartments within the central hull.

Installed in machinery compartment 60 (also FIG. 2) are water-ballast pump 88, water-jet propulsion/steering units 90, and battery bank 92.

Outboard of the machinery compartment are outer flotation compartments 20, wheel wells 30 (also FIGS. 1 and 5), and pneumatic-tired wheels 28 (also FIGS. 1, 3, and 5).

Forward of the machinery compartment are forward water-ballast tanks 94, forward flotation compartment 18, main fuel tank 96, outer fuel tanks 98, winch 40, and winch compartment 41 (also FIG. 2).

Aft of the machinery compartment are aft water-ballast tanks 102, aft flotation compartment 22, and stern compartment 62 (also FIG. 2).

FIG. 5 is an orthogonal, port-side view of the ferry in its land mode of operation. Items variously shown in FIG. 5 include for example: central hull 10 (also FIGS. 1, 2, 3, and 4), retractable towing tongue 32 (also FIGS. 1, 3, 4, and 8), port wheel well 30 (also FIGS. 1 and 4), port pneumatic tired wheels 28 (also FIGS. 1, 3, and 4), hinged port outboard hull 12 (also FIGS. 1, 2, 3, and 4), and (exaggerated in size) port hull-locks 80, and port hull-lock "keyholes" 104. The hull-locks may incorporate conventional items used for example to attach multi-mode shipping containers to trailers, etc., though adapted and placed according to the particular desired use for interlocking otherwise adjustable hulls during rigorous ferrying use. For example, one such locking device that may be adapted for use in interlocking otherwise adjustable hulls according to the present invention is described in issued U.S. Pat. No. 4,697,967 to Schulz et al, which is herein incorporated in its entirety by reference thereto.

FIG. 6 is a dimetric line-diagram showing the arrangement of central hull heavy frame 16, which is also partially shown in FIG. 7. FIG. 7 is a dimetric line-diagram showing the arrangement of main frame 14 and portions of the central hull heavy frame (fully shown in FIG. 6) to which the main frame is attached. To clarify the main frame's position, phantom lines indicate other heavy-frame members as shown in FIG. 6.

Figure 8:
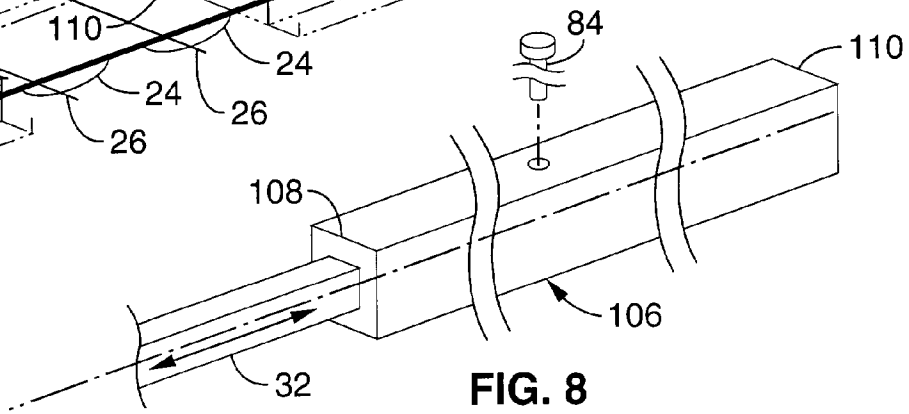
FIG. 8 is a dimetric drawing of the towing tongue, tongue housing, and tongue securing pin.

FIG. 7 shows axles 26, and suspension systems 24 (drawn according to one illustrative embodiment as leaf springs) attaching the axles to the main frame. The centerline drawn partially through the main frame clarifies positions of towing tongue 32 (FIGS. 1, 3–5, and 8) and towing tongue housing 106 (FIG. 8). Additionally indicated for clarity are tongue housing/main frame forward junction 108 (also FIG. 8), and tongue housing/main frame aft junction 110 (also FIG. 8).

FIG. 8 is greatly enlarged compared to FIGS. 6 and 7, and shortened as indicated by the curved break-lines. Clearance between the towing tongue and its housing is generally desired to be minimized.

FIG. 8 is a dimetric drawing of retractable towing tongue 32 (also FIGS. 1, and 3–5), tongue housing 106, and tongue securing pin 84, indicating tongue housing/main frame forward junction 108 (also FIG. 7), and tongue housing/main frame aft junction 110 (also FIG. 7). The centerline drawn partially through main frame 14 (FIG. 7) clarifies positions of the tongue/housing and main frame.

Figure 9:
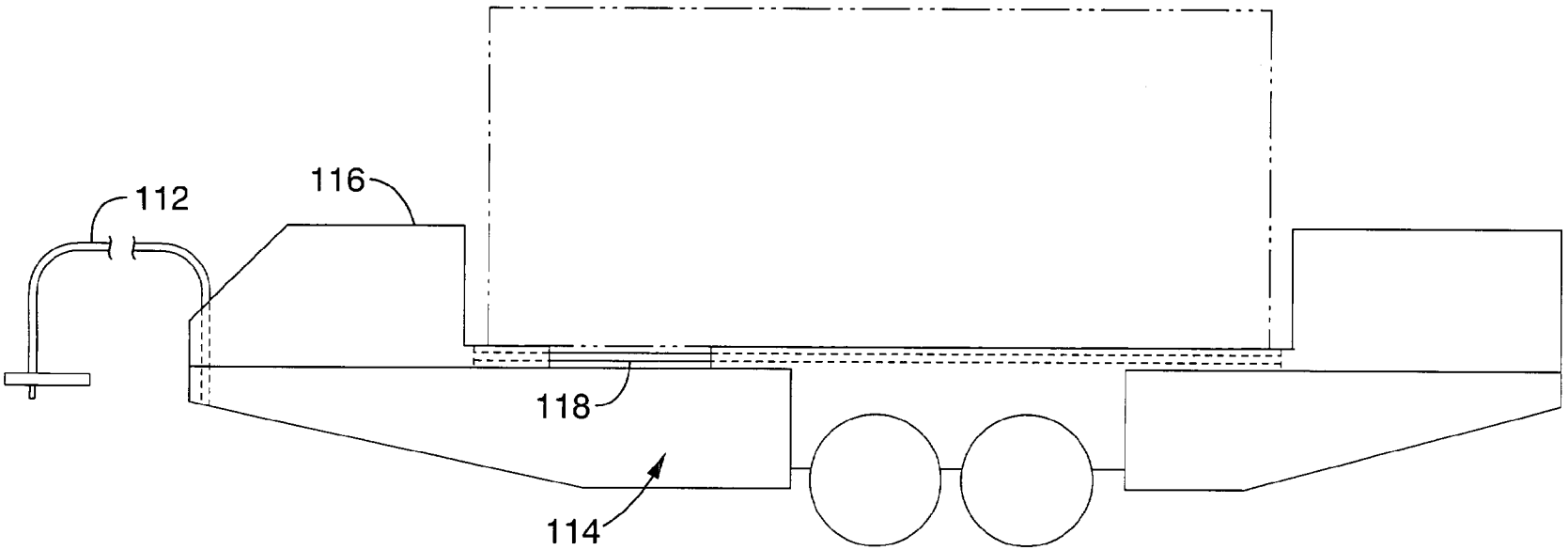
FIG. 9 is an orthogonal port-side view of the land mode of one embodiment of the ferry with outboard hulls adapted to carry cargo in the road towed configuration.

FIG. 9 is an orthogonal port-side view of the land mode of another ferry embodiment of the invention. Hull hinges and hull-lock installations are omitted but may be incorporated according to highly beneficial variations. FIG. 9 shows removable, fifth-wheel, alternative towing tongue 112, alternative central hull 114, port alternative outboard hull 116, port inflatable bellows 118, and a shipping container drawn in phantom lines.

Figure 10:
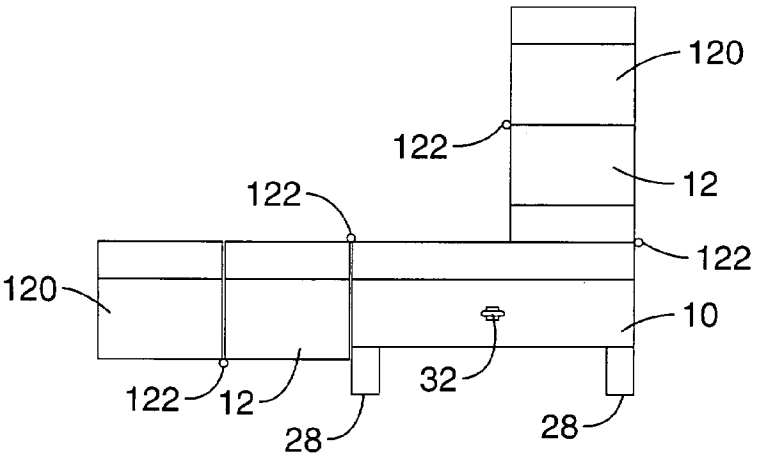
FIG. 10 is an orthogonal view of another embodiment of the ferry illustrated with a set of secondary outboard hulls illustrated with one set of hulls in the deployed position for ferrying and the other set of hulls in the stowed position for road towing.

FIG. 10 is an orthogonal bow view of yet a further ferry embodiment of the invention. Outboard hull 12 is hinged to central hull 10 with a first hull hinge 122. Outboard hull 12 is hinged to secondary outboard hull 120 with a second hull hinge 122. The port outboard hull 12 and secondary outboard hull 120 are illustrated in the road towed configuration. The starboard outboard hull 12 and secondary outboard hull 120 are illustrated in the ferry configuration.

Figure 11:
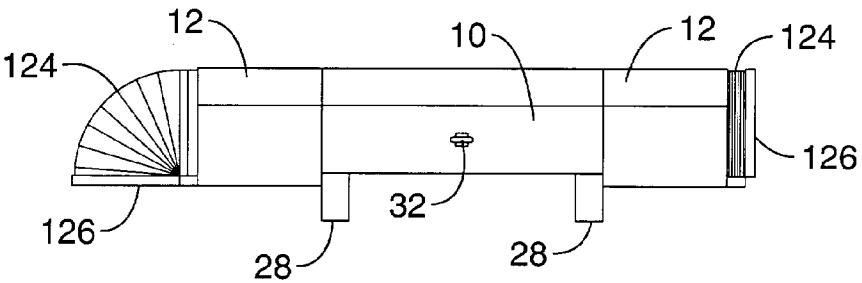
FIG. 11 is an orthogonal view of another embodiment with inflatable bellows attached to the outer hulls illustrated with one bellows deployed and the other bellows stowed.

FIG. 11 is an orthogonal bow view of still another ferry embodiment of the invention. Outboard inflatable bellows 124 are attached to outboard hull 12 and hinged bellows cover plate 126. The port outboard inflatable bellows 124 and bellows cover plate 126 are illustrated in the road towed configuration and the starboard outboard hull 12, outboard inflatable bellows 124 and outboard bellows cover plate 126 are illustrated in the ferry configuration. Though not shown, it is to be appreciated that bellows 124 may take many different alternative forms however to that shown in FIG. 11. In one regard, cover plate 126 may be located over bellows 124 in the ferry configuration, rather than being located vertically under the bellows 124 in a horizontal configuration. Moreover, cover plate 126 may not be required at all. For example, a compressor/vacuum pump system (either integrated or as separate gated devices) may be used to inflate and deflate, respectively, the bellows 124, which may not be required to be covered in some cases, or other covering means may be employed (e.g. doors, or removable caps, etc.).

Figure 12:
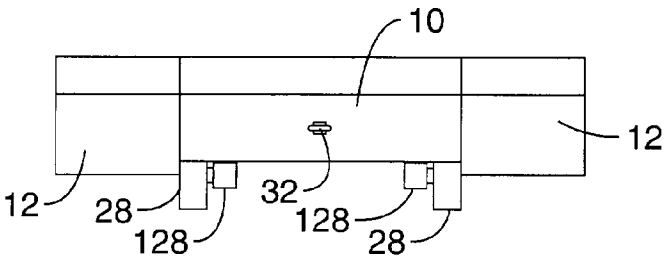
FIG. 12 is an orthogonal view of another embodiment with motors coupled to the wheel assembly.

FIG. 12 is an orthogonal bow view of a fourth alternative embodiment of the ferry. Motors 128 are coupled to the pneumatic-tired wheels 28.

By general reference to the foregoing description and to the Figures in general, the following is a general description of various modes of operating the present invention according to its various embodiments, and by further reference to illustrative is structures where helpful for a complete understanding of certain features.

As elsewhere herein mentioned, various items are not always shown in detail in each of the drawings, or may not be shown at all, though are still contemplated for inclusion with various of the other features shown. To make the following description of the operational modes more readable, such items are not always individually noted "not shown." Examples of such items include: installation sockets of the lifeline posts, kingpost, mast, mast stabilizing strut, and mast stabilizing bipod, outboard hull rigging points, a tow vehicle and its brake and "road light" connections to the ferry, mooring lines, fairleads, anchors, on-board loads such as vehicles and equipment, a dinghy, navigation lights other than the masthead and anchor lights, and a lever-action chain binder.

The ferry is positioned near a launch site. Kingpost 34 (FIG. 1) is installed upright in its below-deck socket. Each end of wire-rope bridle 38 (FIG. 1) is rigged through one of two snatch blocks 36 (FIG. 1) atop the kingpost, and hooked to rigging points on each of hinged outboard hulls 12 (also FIGS. 1, and 3–5).

A cable from below-deck winch 40 (FIG. 4) is hooked to the midpoint of the bridle. The cable is winched in, causing the outboard hulls to rotate upward and outward until their center of balance shifts outward. The cable is let out, causing the hulls to rotate downward to their water-mode positions.

Central-hull bow hinged gunwale 72, outboard hull hinged gunwales 74, and central hull stern hinged gunwale 76 are pivoted up from the deck and over to positions where they extend ahead or astern as appropriate. Outboard hulls are secured in their water-mode positions by eight locks 80 (see FIG. 5), whereas the four port locks are shown, and similar starboard locks are provided but are not visible. These locks are accessible through eight access wells 78 (see FIG. 4). Whereas such number and placement of locks as shown and described for this embodiment are generally considered appropriate for providing sufficient rigidity in the locked configuration to withstand many rigorous heavy load ferrying modes of operation, other numbers, placements, or configurations are contemplated as would be apparent to one of ordinary skill based upon review of this disclosure.

Starboard vehicle ramp 70 and the port ramp (not shown), which are previously otherwise fastened to the inward sides of the un-deployed outboard hulls, are repositioned outward of the hulls when the hulls are deployed. Such ramps are rigged to the wire-rope bridle, unfastened from the hulls, and winched aboard. Again, other suitable substitute arrangements for deploying and securing such ramps in the various configurations are considered within the scope of the present invention.

Lifeline posts 64 are set upright in their below-deck sockets. Port and starboard lifelines 66 and stern lifeline 68 are installed. Then gunwales across the stern are pivoted upright and fastened to the lifeline posts.

The ferry is backed into the water and moored behind the tow vehicle. Braking and "road light" systems are disconnected. Towing tongue 32 (FIGS. 1, 3–5, and 8) is detached from the tow vehicle and retracted into central hull 10 (FIGS. 1, 3, 4, and 5).

If the vehicle ramps are required to embark a vehicle or equipment, they are skidded forward, such as for example by using winch 40 (FIG. 4), kingpost 34 (FIG. 1), and various additional rigging as would be apparent to one of ordinary skill, and attached to the bow so that they extend onto the shore. If the ramps are not required, or after their use, they may be otherwise positioned, such as according to one highly beneficial example set on edge and fastened to port and starboard lifeline posts 64. Such an on-edge position allows the ramps to serve as gunwales while conserving deck space. Rigging is then detached from the kingpost which is then stowed. If a minimal ramp is sufficient, central hull bow gunwale 72 may be adapted for such purpose. purpose.

It is to be appreciated accordingly that one or more vehicles and/or cargo are taken aboard, using the ramps or central hull bow gunwale as just described immediately above. If desired, ramps are stowed, such as for example by further using the winch and various rigging. Then a bow lifeline (not shown) may be installed.

Control/display panel 58 according to the illustrative embodiments shown is already connected by its umbilical cord to fathometer and radar equipment, propulsion/steering units, and various components of ballasting and lighting systems. The panel is taken from machinery compartment 60 (also FIG. 4) and suitably placed, such as on the steering wheel of an on-board vehicle being transported by the ferry of the present invention.

According to further beneficial embodiments of the invention, water is pump-adjusted into selected water-ballast tanks 94 and 102 (FIG. 4) to adjust fore/aft trim and port/starboard list. This feature is considered in particular to be highly beneficial for transporting heavy loads such as tanks, machinery, oil-rig equipment, etc., over waterways.

The following paragraphs provide certain more specific specifications such as dimensions that are considered suitable according to certain highly beneficial detailed embodiments. Such particular specifications, and their combination in particular, are considered to represent a highly beneficial mode of the invention for certain intended uses. However, such is provided for the purpose of providing further understanding of the invention and is not intended to be limiting to the broad scope of various aspects the nearest one-tenth meter.

More specifically, bow compartment 42 (also FIG. 4) contains mast stabilizing bipod 54 comprising two spars which are for example about 2.1 meters (7 feet) long, coupled to the mast. They are set into angled sockets at opposite ends of the bow compartment and attached at their tops.

Mast 44 comprises two sections; each being for example about 2.1 meters (7 feet) long, connected by locking mast pivot 52. The mast is removed from the bow compartment, unfolded, and locked into its full length of about 4.2 meters (14 feet). Next it is attached at its base to a pivoting mast-installation socket in the bow compartment. Then it is set upright and attached to the mast stabilizing bipod. Finally, stabilizing strut 56 is installed from the mast to the centerline of the central hull. Atop the mast are anchor light 46, radar transceiver 48, and masthead light 50. Gunwales across the bow are pivoted upright and attached to lifeline posts and the mast.

The navigation lights mentioned in this paragraph are in position at this point and need no installation; they are included here for consistency. Port and starboard sidelights and a stern light are fixed to, respectively, amidships port and starboard lifeline posts, and the centerline stern lifeline post. Notwithstanding the foregoing, other modes, such as removable or otherwise adjustable lighting assemblies, are also contemplated as suitable substitutes for certain applications of the present invention.

Pre-underway checks are done, mooring lines are taken aboard, and the ferry is maneuvered by water-jet propulsion/steering units 90 (only FIG. 4).

Other navigation lights carried aboard are mentioned here for consistency. Navigation lights are displayed from prescribed positions to indicate towing, lost or restricted ability to maneuver, grounding, etc.

According to further beneficial embodiments of the invention, the ferry may cross or be extricated from shoal water or ground by use of winch 40 (FIG. 4). In this embodiment, wheels 28 (FIGS. 1, and 3–5) assist by reducing friction, suction, and risk of hull damage. Propulsion and water-ballast system are employed as appropriate. The winch cable is run ahead or astern through fairleads, using a dinghy if needed. Then the cable is attached to a fixed object, or to the anchor(s) which may be set into the ground or dropped from the dinghy. The cable is drawn in and the sequence is repeated as necessary.

Prior to entering contaminated water, such as at a hazardous material release, extra water may be pumped into water-ballast tanks 94 and 102 (FIG. 4). This permits on-site adjustment of trim and list, without taking contaminated water into the tanks. Instead, clean water is discharged.

Water ballast is beneficially adjusted as necessary to improve stability in adverse winds, waves, and currents.

Landing procedures and preparations for road towing are essentially the reverse of launching procedures and preparations for waterborne operation.

As outboard hulls 12 (FIGS. 1, 3, 4, and 5) are returned to their land-mode positions, a conventional lever-action chain binder may be used to shift the hulls' center of balance inward. For that inward shifting, the chain binder may be hooked for example to rigging points on the aft ends of the outboard hulls.

"Pre-road" checks are done and the tow-vehicle/payload/ferry combination is operated as a conventional truck and trailer.

In a highly beneficial aspect of the invention illustrated for example by the combination of features and specifications described above, the present road towed ferry complies with vehicle/trailer regulations for length, width, height, weight, and axle spacing on all interstate highways, national network highways, and most public roads. In a further highly beneficial embodiment, the dimensions and the weight of the ferry may also be constructed to meet the requirements for air transport by C-130 or C-17A aircraft and used to transport heavy construction and mining equipment and military vehicles.

In one further more detailed embodiment of the ferry, shown in FIG. 9, removable fifth-wheel towing tongue 112 replaces retractable towing tongue 32. This allows alternative central hull 114 and alternative outboard hulls 116 to be about 1.1 meters (3 feet) longer. Outboard hulls are inset so that a shipping container, having a length of about 6.1 meters (20 feet) and height of about 2.6 meters (8.5 feet), can be carried on land. The shipping container's position is indicated by phantom lines in FIG. 9. A portable gantry (not shown) suspends the container while the ferry is rigged out. Then the container is set on the ferry or on a truck to be carried aboard. Prior to launch, port inflatable bellows 118 and its starboard counterpart are pressurized using an on-board air compressor (not shown). The inflatable bellows compensate for outboard hull flotation which was reduced by the insets for the shipping container.

In another further detailed embodiment shown in FIG. 10, secondary outboard hulls 120 are attached to outboard hulls 12 with hull hinge 122 to increase ferry buoyancy and stability where height in the road towed configuration is not a limiting factor.

In still a further more detailed embodiment shown in FIG. 11, outboard inflatable bellows 124 are attached to outboard hulls 12 to add buoyancy and stability to the ferry. Bellows cover plate 126 protects the outboard inflatable bellows 124 from contact with submerged objects during ferry operation. It is to be appreciated however, that this particular configuration of bellows 124 and cover plate 126 may be modified to suit a particular purpose. For example, cover plate 126 may be transposed to be located above bellows 124, instead of below as shown in FIG. 11. Or, bellows may be provided without requiring a cover plate, at least not one integrated as a cover during ferrying operation (e.g. a plate may be used for covering the bellows in the contracted state, such as during kedging). A pneumatic pump and/or vacuum system may be incorporated to operate opening and closing of such bellows, with or without a cover plate in the various configurations.

According to still a further detailed embodiment shown in FIG. 12, high torque, low speed motors 128 are coupled to pneumatic-tired wheels 28 and used to maneuver the ferry for loading, launching, landing and kedging operations. Such may be for example of the electric type motor, or hydraulic. Various motor types and configurations are contemplated, though not shown, as would be apparent to one of ordinary skill, which substitutes may be or may not be high torque and/or low speed, though such combination of features is considered highly beneficial for kedging. Moreover, other placements, configurations, or types of tired-wheels may be used, which may be either pneumatic or of other types, e.g. solid.

As may be seen according to the foregoing description, the road-towed ferry of the present invention can transport afloat its tow vehicle and substantial loads as an intact unit, and do so in a comparatively safe, cost-effective manner.

The ferry's ability to deliver relatively heavy emergency equipment from the most expedient launch point, despite adverse conditions, greatly enhances protection of human life and property.

Significant exemplary uses and benefits of the ferry include, without limitation: (a) better access to isolated areas for mining, development and construction, (b) better monitoring and protection of wetland and wildlife areas, (b) access and reuse of idle farmlands and abandoned mineral sites not presently economically accessible, (c) reduction of costs, terrain damage, and fuel-combustion pollution related to conventional marine operations. For the purpose of further illustration, other exemplary uses may include, without limitation: scientific, military, and commercial expeditions, transporting relatively heavy emergency equipment such as used by search and rescue and mobile medical personnel, as well as educational and recreational endeavors.

Various features provide personnel safety, seaworthiness, and the ability to cope with unfavorable situations. Such features include perimeter lifelines, gunwales to reduce deck wash-over, and closed-cell foam in flotation compartments and outboard hulls. The water-ballast system counterbalances on-board loads and otherwise improves stability in adverse winds, waves, and currents. The water-ballast system, winch, intact wheels, and other equipment assist in crossing or extrication from shoal water or ground.

The ferry's extensive use of conventional items and installations in a relatively simple design reduces construction, maintenance, and repair costs and complications. The ferry also can be readily adapted to meet dimensions for road and air transport.

Various of the features described above are considered highly beneficial with respect to the particular embodiments, though are illustrative and other suitable substitutes may be made without departing from the scope of the invention. For example, one of ordinary skill may find other suitable substitutes for the following features described (without limitation): aluminum materials such as for plate or support materials; configuration, placement, or number of wheels; fixed versus retractable wheels; configuration, shape, or number of hulls, such as outboard hulls; types and configuration of gunwales; configuration and type of ballasting system; size and dimensions of the various components; number, location, shape, or other configuration for various of the hull compartments; location, number, sizes, and types of winches employed; size, location, number and adjustable configuration of the kingpost; configurations and systems for coupling the kingpost with outboard hulls for adjusting their respective positions between road tow and ferry configurations; location and configuration for various controls such as for lights and other ferry craft operation controls; type, location, size, and number of motors; etc. For further illustration, other materials than aluminum may be used for constructing various of the ferry's features, such as composites, plastics, or other metal alloys, e.g. for use in the various plate materials of the hulls or supports such as internal support members, decking, etc.

Moreover, a ferry according to the various embodiments of the invention may be provided with all of the features herein described, or only portions thereof, which combinations may be sold together or separately. For example, a ferry may be manufactured and sold without certain desired equipment for later assembly, such as for example without limitation with respect to: fathometers, propulsion system, winches, lighting fixtures, drive motors, other equipment, etc. In this regard, such ferry may be "adapted to" include or otherwise couple to such equipment without departing from the intended scope hereof.

Notwithstanding the foregoing array of suitable substitutes, the various features of the embodiments shown, in particular by reference to features and their various dimensions provided in FIGS. 1–8, are believed highly beneficial for providing the ability to operate in a manner sufficient to achieve various of the objects of the invention. For example, ferry craft of such design, materials, and dimensions is believed to comply with most public roadway regulations (e.g. interstate highway regulations) in the tow configuration, and provide the ability to ferry loads of up to at least about 16 tons over water. Such configuration is considered highly beneficial for example for transporting light armored vehicles, such as for example of the FCS type described above.

Figure 13:
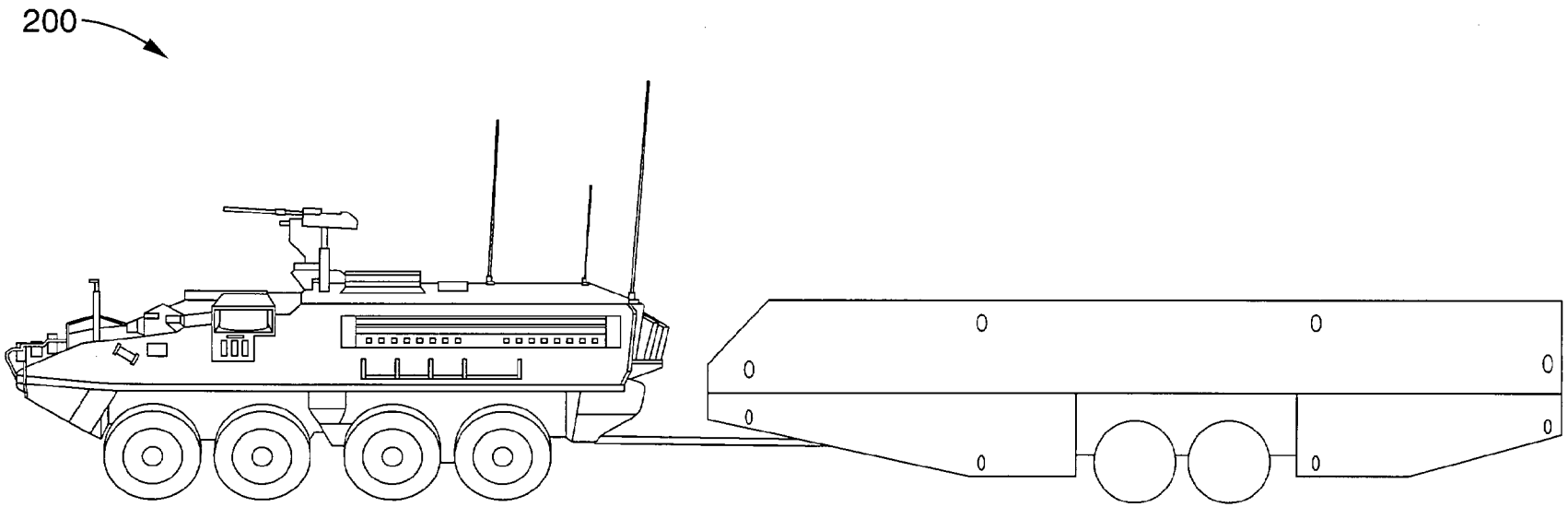
FIG. 13 shows a side view of another embodiment of the invention with an armored vehicle of the Stryker type towing a road towed ferry in a road tow configuration.
Figure 14:
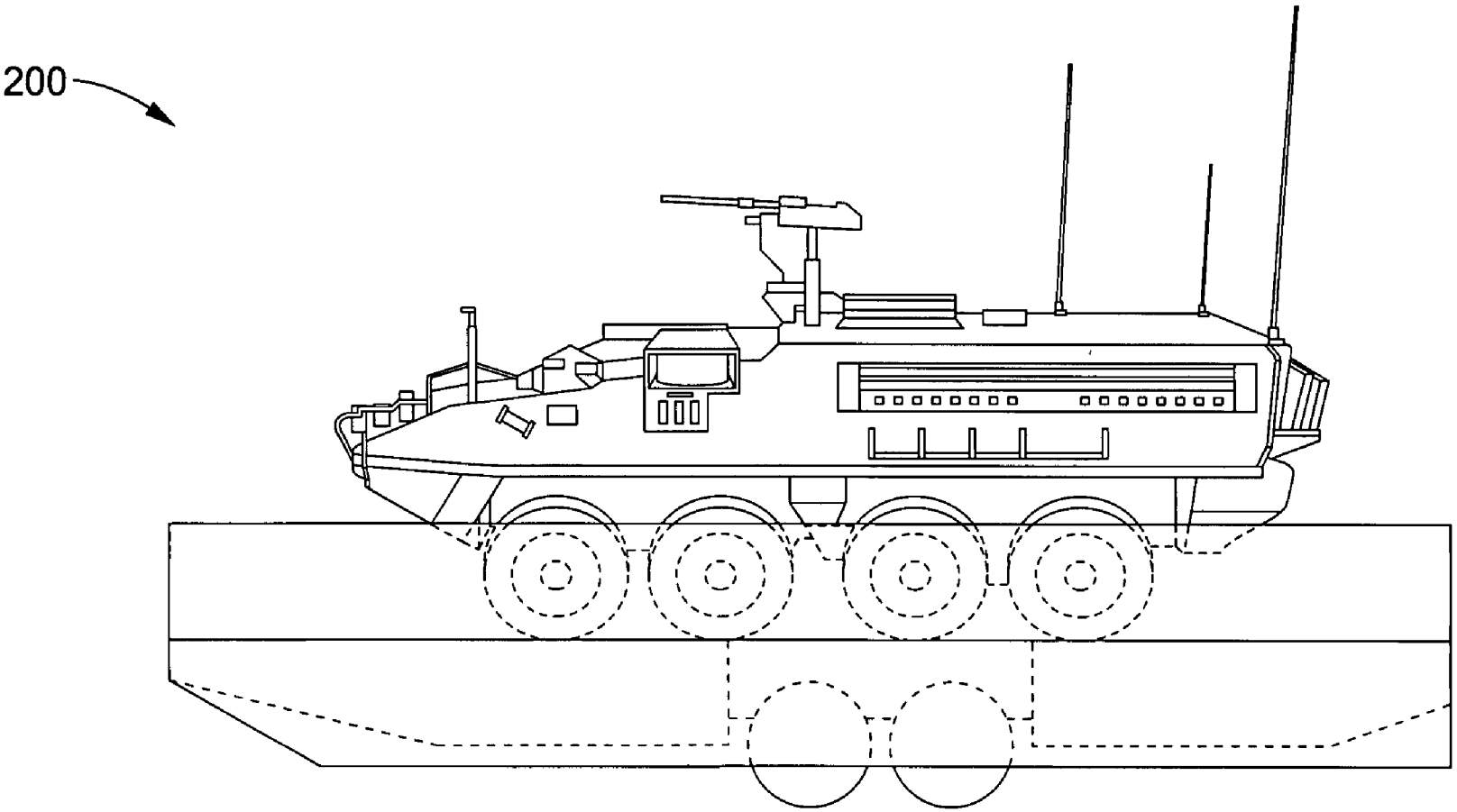
FIG. 14 shows a similar side view of the embodiment shown in FIG. 13, except with the armored vehicle and road towed ferry in a ferry configuration.

However, such configurations and dimensions may be modified to suit other purposes. For example, various of the dimensions of the ferry's hull system may be modified to suit ferrying of lighter loads, and thus itself be lighter for towing by lesser tow vehicles. Or, conversely, such dimensions may be enlarged for heavy loads. In one particular beneficial regard, relatively slight increases to the various hull dimensions, corresponding to slight increase in the length and width of the ferry in ferry configurations, is believed to add sufficient buoyancy to increase the load capacity to up to at least about 19 tons. This is considered highly beneficial for ferrying such heavier loads, such as for example a Stryker type of armored vehicle. For further illustration, FIG. 13 shows a side view of an illustrative armored vehicle of the Stryker type towing an exemplary ferry of the present invention in the tow configuration (the example shown in FIG. 5 is used for the ferry for illustration). By launching the ferry at a water launch site, deploying the outboard hulls into the ferry configuration, deploying the ramps from the floating ferry onto ground at the site, and driving the tank onto the ferry, (not shown) the ferry may then be used in the ferry configuration to ferry the armored vehicle over water to a remote destination, as shown for further illustration in FIG. 14.

Still further modifications may be made to suit use with other vehicles, such as particular types of construction vehicles, tractor trailers (e.g. up to at least about 20 ton capacity), HMMV vehicles, recreation vehicles ("RV's"), automobiles and trucks (e.g. weighing just a couple of tons), etc. One or only a few types of ferries of the present invention may be suitable for use with a wide variety of such range of vehicle types and weights. However, by tailoring the dimensions of the ferry of the invention to narrow classes of vehicles, the ferry may be best suited for the combined intended use of being (a) towed by a tow vehicle of a particular type; and (b) in turn ferrying the tow vehicle over water.

In a further regard, the various embodiments for the road towed ferry of the invention may be ideally suited for transport within C-130 or C-17A aircraft, such as adjunctive to transporting armored vehicles such as of the Stryker and FCS light armored vehicles described above. For embodiments specially adapted for transport within the C-130 aircraft, dimensions of the road towed ferry in the road tow configuration will generally be provided according to the following specifications: a width of no more than about 123 inches; a height of no more than about 9 feet; a length of no more than about 55.4 feet; and a total weight of no more than about 38,061 pounds. With respect to embodiments specially adapted for transport in aircraft of the C-17A type, the ferry will generally be constructed as follows with respect to the tow configuration: a width of no more than about 18 feet; a height of no more than about 13 feet; and a length of no more than about 88 feet. Accordingly a ferry adapted to meet the C-130 specifications generally meets the requirements for air cargo transport on a C-17A plane, though in contrast a ferry according to the invention may be specially adapted to have larger dimensions to accommodate ferrying larger loads and meet requirements for C-17A transport but not the C-130 requirements. According to the foregoing, the terms "tow configuration" are generally herein used to describe the ferry's configuration for transport, generally being the same for road towing and other transport means such as via air cargo transport as just described. However, it is further contemplated that a ferry according to the invention may have different configurations for specific road towing and cargo transport. For example, wheels that are of the pneumatic type are often deflated for air cargo transport to minimize the height dimension of the vehicle, whereas they are inflated for road towing.

In another regard, the ferry of the present invention according to the various embodiments herein shown or described is generally adapted for beneficial road towing capabilities that meet public road regulations without requiring special permits, such as in particular the generally uniform national network/interstate roadway standards. As such, a ferry adapted for such use will generally have the following specifications with respect to dual axle embodiments (such as shown in various of the Figures): a width of no more than about 102 inches; a length of no more than about 48 feet; a total height of no more than about 14 feet, and a total weight of no more than about thirty four thousand pounds (17 tons).

According to the foregoing, further benefit is gained by adapting the ferry in the tow configuration to meet multiple of the requirements provided immediately above, such as in particular meeting the specifications of both the road regulations as well as C-130 and/or C-17A air cargo transport planes. For illustration, a ferry embodiment may be adapted to meet both the C-130 specifications, as well as the road regulations, such as those herein identified for dual-axle vehicles. By further adapting the ferry in the ferry configuration to carry loads over water that are up to at least about 16 tons, or even about 19 tons, a highly mobile ferry is provided for extremely versatile use, in particular for military applications in both war and peacetime environs for military equipment and vehicle transport, as well as the other beneficial uses such as described by illustrative examples elsewhere hereunder.

Various dimensions and other specifications have been herein provided for the purpose of illustrating certain particular detailed embodiments that are considered highly beneficial with respect to the present invention. However, such may be modified to suit particular needs without departing from the intended scope hereunder, and the accuracy or suitability for any particular such specification, or various combinations thereof, to meet one or more of the objects of the invention may be corrected by one of ordinary skill without departing from the scope of the invention.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A road towed ferry, comprising:

a central hull;

a plurality of outboard hulls that are adjustable relative to said central hull between a road tow configuration and a ferry configuration;

wherein in the road tow configuration the ferry is adapted to be towed on a road by a tow vehicle;

a closed ballast system that is adapted to change the center of gravity of said ferry longitudinally and laterally in the ferry configuration;

wherein said closed ballast system is positioned within said central hull; and a nonretractable wheel carriage coupled to said central hull;

wherein said wheel carriage is adapted to support the weight of said ferry and said load during launching, kedging and landing.

2. A road towed ferry, comprising:

an adjustable hull system that is adjustable between a tow configuration and a ferry configuration;

a closed ballast system adapted to change the center of gravity of said ferry longitudinally and laterally in the ferry configuration;

wherein said closed ballast system is positioned within said central hull; and a plurality of vehicle ramps adapted to couple to said central hull;

wherein said vehicle ramps are further adapted to form gunwales when coupled to said hull and said ferry is in said ferry configuration.

3. A road towed ferry, comprising:

a hull system that is adjustable between a road tow configuration and a ferry configuration;

a closed ballast system adapted to change the center of gravity of said ferry longitudinally and laterally in the ferry configuration;

wherein said closed ballast system is positioned within said central hull;

a nonretractable wheel carriage coupled to said central hull;

wherein said wheel carriage is adapted to support the weight of said ferry and said load during launching, kedging and landing; and a high torque motor positioned on said wheel carriage;

wherein said motor is adapted to propel said ferry during launching kedging and landing.

4. A road towed ferry, comprising:

an adjustable hull system that is adjustable between a road tow configuration and a ferry configuration;

a nonretractable wheel assembly coupled to said hull system;

said wheel assembly having at least two wheels;

at least one high torque motor positioned on said wheel assembly;

said motor adapted to propel said ferry during launching, kedging and landing;

wherein in the road tow configuration the ferry is adapted to be towed on a road by a tow vehicle; and wherein in the ferry configuration the ferry is adapted to ferry a load over water.

5. The road towed ferry of claim 4, wherein said hull system further comprises:

a central hull;

a plurality of outboard hulls that are adjustable relative to the central hull between first and second respective positions corresponding to the road tow and ferry configurations respectively; and a removable kingpost adapted to move said outboard hulls between the first and second respective positions.

6. The road towed ferry of claim 4, further comprising:

a closed ballast system adapted to change the center of gravity of said ferry longitudinally and laterally in the ferry configuration;

wherein said closed ballast system is positioned within said adjustable hull system.

7. The road towed ferry of claim 4, further comprising:

a plurality of vehicle ramps coupled to said hull system;

wherein said vehicle ramps are adapted to form gunwales.

8. The road towed ferry of claim 4, wherein in the ferry configuration the ferry is adapted to ferry over water a towing vehicle that is adapted to tow the ferry on a road in the road tow configuration.

9. The road towed ferry of claim 4, wherein the hull system further comprises:

a central hull with a top surface;

a plurality of outboard hulls;

wherein said outboard hulls are adapted with insets;

wherein in the road tow configuration said top surface is adapted to carry a load;

wherein in the road tow configuration said load is positioned in said insets of said outboard hulls; and wherein in the ferry configuration said outboard hulls are adapted to carry said load.

10. The road towed ferry of claim 4, further comprising:

a kedging winch that is adapted to assist the ferry in kedging in the ferry configuration.

11. The road towed ferry of claim 4, wherein said wheel assembly comprises two axles.

12. The road towed ferry of claim 4, wherein said wheel assembly comprises three axles.

13. The road towed ferry of claim 4, wherein said motor is electric.

14. The road towed ferry of claim 4, wherein said motor is hydraulic.

15. A road towed ferry comprising:

a hull system that is adjustable between a road tow configuration that is adapted to be towed on a road by a tow vehicle and a ferry configuration that is adapted to ferry a load over water;

a closed ballast system that is adapted to change the center of gravity of said ferry longitudinally and laterally in the ferry configuration;

wherein said closed ballast system is positioned within said hull system;

a plurality of vehicle ramps adapted to couple to said hull system;

wherein said vehicle ramps are further adapted to form gunwales coupled to said hull system when said ferry is in said ferry configuration.

16. A road towed ferry, comprising:

a central hull;

a first pair of outboard hulls that are adjustable relative to said central hull between first and second respective positions corresponding between a road tow configuration and a ferry configuration for the ferry, respectively;

a second pair of outboard hulls hingedly coupled to said first pair of outboard hulls;

wherein said second pair of outboard hulls are adjustable between a road tow configuration and a ferry configuration;

a closed hydraulic ballast system that is adapted to change the center of gravity of said ferry longitudinally and laterally in the ferry configuration;

wherein said closed ballast system is positioned within said central hull;

wherein in the road tow configuration the ferry is adapted to be towed on a road by a tow vehicle; and wherein in the ferry configuration the ferry is adapted to ferry the tow vehicle over water.

17. A road towed ferry, comprising:

a hull system with a central hull and a plurality of outboard hulls that are each adjustable between first and second respective positions that correspond with road tow and ferry configurations for the ferry;

a nonretractable wheel system coupled to the central hull;

a kedging winch coupled to the central hull;

a closed ballast system positioned within the hull system;

wherein said ballast system is adapted to adjust the center of gravity of the ferry in the ferry configuration;

a gunwale system that cooperates with the hull system and includes a plurality of gunwales that each has an adjustable position between the road tow and ferry configurations; and a propulsion system cooperating with the hull system;

wherein in the road tow configuration the ferry is adapted to be towed over a road by a tow vehicle; and wherein in the ferry configuration the ferry is adapted to ferry a load over water.

18. The road towed ferry in claim 15, wherein in the road tow configuration the ferry comprises:

a width of about 123 inches or less;

a height of about 9 feet or less;

a length of about 55.4 feet or less; and a total weight of about 38,061 pounds or less.

19. The road towed ferry of claim 15, wherein in the road tow configuration the ferry comprises:

a width of about 18 feet or less;

a height of about 13 feet or less; and a length of about 88 feet or less.

20. The road towed ferry in claim 15, wherein:

in the road tow configuration the ferry comprises a width of about 102 inches or less, a length of about 48 feet or less, a total height of about 14 feet or less, and a total weight of about thirty four thousand pounds or less; and in the ferry configuration the ferry is adapted to ferry a load of up to at least about 16 tons over water.

21. The road towed ferry of claim 15, wherein in the ferry configuration the ferry is adapted to ferry a load of up to at least about 19 tons over water.

22. The road towed ferry of claim 15, wherein the hull system comprises:

a central hull; and a first pair of outboard hulls that are adjustable relative to the central hull between first and second respective positions corresponding to the road tow and ferry configurations, respectively; and a second pair of outboard hulls hingedly coupled to said first pair of outboard hulls;

wherein said second pair of outboard hulls are adjustable relative to said first pair of outboard hulls corresponding to the road tow and ferry configurations.

23. The road towed ferry of claim 22, further comprising:

a removable kingpost that is adapted to move said first pair of outboard hulls between their first and second respective positions;

a plurality of inflatable bellows coupled to said second pair of outboard hulls;

wherein said inflatable bellows are adapted to inflate in said ferry configuration.

24. The road towed ferry of claim 15, further comprising.

a plurality of hinged gunwales coupled to said hull system;

a plurality of inflatable bellows coupled to said hull system;

wherein said inflatable bellows are adapted to inflate in said ferry configuration.

25. The road towed ferry of claim 15, wherein in the ferry configuration the ferry is adapted to ferry a tow vehicle that is adapted to tow the ferry on a road in the road tow configuration.

26. The road towed ferry of claim 15, wherein said hull system comprises:

a central hull with a top surface;

a plurality of outboard hulls;

wherein said outboard hulls have cutouts;

wherein in the road tow configuration said top surface is adapted to carry a load;

wherein in the road tow configuration said cutouts are adapted receive said load; and wherein in the ferry configuration said outboard hulls are adapted to carry said load.

27. The road towed ferry of claim 15, further comprising:

a kedging winch that is adapted to assist the ferry in kedging in the ferry configuration.

28. The road towed ferry of claim 15, further comprising:

a wheel assembly coupled to said hull system; and a high torque motor positioned on said wheel assembly.

29. The road towed ferry of claim 28, wherein in the ferry configuration said wheel assembly is substantially non-retractable.

30. The road towed ferry in claim 16, wherein in the road tow configuration the ferry comprises:

a width of about 123 inches or less;

a height of about 9 feet or less;

a length of about 55.4 feet or less; and a total weight of about 38,061 pounds or less.

31. The road towed ferry of claim 16, wherein in the road tow configuration the ferry comprises:

a width of about 18 feet or less;

a height of about 13 feet or less; and a length of about 88 feet or less.

32. The road towed ferry in claim 16, wherein:

in the road tow configuration the ferry comprises a width of about 102 inches or less, a length of about 48 feet or less, a total height of about 14 feet or less, and a total weight of about thirty four thousand pounds or less; and wherein in the ferry configuration the ferry is adapted to ferry a load of up to at least about 16 tons over water.

33. The road towed ferry of claim 16, wherein in the ferry configuration the ferry is adapted to ferry a load of up to at least about 19 tons over water.

34. The road towed ferry of claim 16, further comprising:

a removable kingpost adapted to move said first pair of outboard hulls between their first and second respective positions.

35. The road towed ferry of claim 16, further comprising:

a plurality of gunwales adapted to couple to said outboard hulls;

wherein said gunwales form vehicle ramps further adapted to couple to said central hull.

36. The road towed ferry of claim 16, wherein in the ferry configuration the ferry is adapted to ferry over water a tow vehicle that is adapted to tow the ferry over a road in the road tow configuration.

37. The road towed ferry of claim 16, wherein:

said central hull comprises a top surface;

in the road tow configuration said top surface is adapted to carry a load;

wherein said outboard hulls are configured to not interfere with said load positioned on said top surface in said road tow configuration; and wherein in the ferry configuration said outboard hulls are adapted to carry said load.

38. The road towed ferry of claim 16, further comprising:

a kedging winch that is adapted to assist the ferry in kedging in the ferry configuration.

39. The road towed ferry of claim 16, further comprising:

a wheel assembly coupled to said hull system; and a high torque motor positioned within said wheel assembly.

40. The road towed ferry of claim 39, wherein in the ferry configuration said wheel assembly is substantially non-retractable.

41. The ferry of claim 17, wherein in the ferry configuration the ferry is adapted to ferry a load of up to at least about 19 tons over water.

42. The road towed ferry of claim 17, wherein in the road tow configuration the ferry further comprises:

a width of about 102 inches or less;

a length of about 48 feet or less;

a total height of about 14 feet or less; and a total weight of about thirty four thousand pounds or less.

43. The road towed ferry of claim 17, wherein in the road tow configuration the ferry further comprises:

a width of about 123 inches or less;

a height of about 9 feet or less;

a length of about 55.4 feet or less; and a total weight of about 38,061 pounds or less.

44. The road towed ferry of claim 17, wherein in the road tow configuration the ferry further comprises:

a width of about 18 feet or less;

a height of about 13 feet or less; and a length of about 88 feet or less.

* * * * *